US010570672B2

(12) United States Patent
Kannegaard et al.

(10) Patent No.: US 10,570,672 B2
(45) **Date of Patent: *Feb. 25, 2020**

(54) OFFSHORE DRILLING RIG AND A METHOD OF OPERATING THE SAME

(71) Applicant: Maersk Drilling A/S, Kgs. Lyngby (DK)

(72) Inventors: Michael Kannegaard, Espergaerde (DK); Allan McColl, Glasgow (GB); Jesper Holck, Humlebaek (DK)

(73) Assignee: Maersk Drilling A/S, Copenhagen K (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/414,852

(22) Filed: May 17, 2019

(65) Prior Publication Data

US 2019/0271195 A1 Sep. 5, 2019

Related U.S. Application Data

(63) Continuation of application No. 14/777,325, filed as application No. PCT/EP2014/055307 on Mar. 17, 2014, now Pat. No. 10,323,467.

(Continued)

(30) Foreign Application Priority Data

May 20, 2013 (DK) ..... 2013 00303
Oct. 22, 2013 (DK) ..... 2013 70604

(51) Int. Cl.
*E21B 15/02* (2006.01)
*E21B 7/12* (2006.01)

(Continued)

(52) U.S. Cl.
CPC ..... *E21B 15/02* (2013.01); *E21B 3/02* (2013.01); *E21B 7/12* (2013.01); *E21B 19/084* (2013.01); *E21B 19/143* (2013.01); *E21B 21/001* (2013.01)

(58) Field of Classification Search
CPC ... E21B 15/02; E21B 3/02; E21B 7/12; E21B 19/084; E21B 19/143; E21B 21/001
See application file for complete search history.

(56) References Cited

U.S. PATENT DOCUMENTS 4,341,373 A 7/1982 Mouton
4,423,994 A 1/1984 Schefers et al.

(Continued)

FOREIGN PATENT DOCUMENTS

DK 168770 B1 6/1994
KR 2012-0059820 A 6/2012

(Continued)

OTHER PUBLICATIONS

International Search Report (PCT/ISA/210) dated Feb. 19, 2015, by the European Patent Office as the International Searching Authority for International Application No. PCT/2014/055307 (3 pages).

(Continued)

*Primary Examiner* — Matthew R Buck
*Assistant Examiner* — Aaron L Lembo
(74) *Attorney, Agent, or Firm* — Buchanan Ingersoll & Rooney PC

(57) ABSTRACT

An offshore drilling rig includes a drill deck, at least one primary well center and a diverter system arranged below the primary well center, a drilling support structure extending upwardly from the drill deck and above the primary well center and the other work center and a first and a second hoisting system supported by the drilling support structure and being adapted for raising or lowering a first and a second (Continued)

load carrier, respectively, and where the offshore drilling rig includes a positioning system adapted for selectively positioning at least the first load carrier in at least a first or a second horizontal position different from the first horizontal position, where the first load carrier in the first horizontal position is positioned above the primary well center, and in the second horizontal position is positioned above the other work center.

21 Claims, 17 Drawing Sheets

Related U.S. Application Data

(60) Provisional application No. 61/787,984, filed on Mar. 15, 2013.

(51) Int. Cl.

| | |
|---|---|
| ***E21B 3/02*** | (2006.01) |
| ***E21B 19/084*** | (2006.01) |
| ***E21B 19/14*** | (2006.01) |
| ***E21B 21/00*** | (2006.01) |

(56) References Cited

U.S. PATENT DOCUMENTS

| | | | |
|---|---|---|---|
| 4,597,447 | A | 7/1986 | Roche et al. |
| 4,850,439 | A | 7/1989 | Lund |
| 5,427,180 | A | 6/1995 | dePaiva Leite |
| 5,762,279 | A | 6/1998 | Horton, III |
| 6,343,662 | B2 | 2/2002 | Byrt |
| 6,766,860 | B2 | 7/2004 | Archibald |
| 6,926,259 | B1 | 8/2005 | Roodenburg et al. |
| 7,926,593 | B2 | 4/2011 | Bailey |
| 2004/0151549 | A1 | 8/2004 | Roodenburg et al. |
| 2007/0251725 | A1 | 11/2007 | Banks |
| 2008/0000685 | A1 | 1/2008 | Humphreys |
| 2010/0147524 | A1 | 6/2010 | Springett et al. |
| 2010/0294568 | A1 | 11/2010 | Taraldrud |
| 2011/0017511 | A1 | 1/2011 | Payne |
| 2011/0127040 | A1 | 6/2011 | Humphreys |
| 2013/0284450 | A1 | 10/2013 | Roodenburg et al. |

FOREIGN PATENT DOCUMENTS

| | | | |
|---|---|---|---|
| WO | 87/02915 | A1 | 5/1987 |
| WO | 99/23348 | A1 | 5/1999 |
| WO | 2004/035985 | A1 | 4/2004 |
| WO | 2007/148977 | A1 | 12/2007 |
| WO | 2008/121071 | A1 | 10/2008 |
| WO | 2012/087119 | A1 | 6/2012 |

OTHER PUBLICATIONS

Written Opinion (PCT/ISA/237) dated Feb. 19, 2015, by the European Patent Office as the International Searching Authority for International Application No. PCT/2014/055307 (6 pages).

OFFSHORE DRILLING RIG AND A METHOD OF OPERATING THE SAME

CROSS-REFERENCE TO RELATED APPLICATIONS

The present application is a continuation of U.S. patent application Ser. No. 14/777,325, which was filed in the U.S. on Sep. 15, 2015, and which is a national stage of PCT International Application No. PCT/EP2014/055307, filed Mar. 17, 2014, which claims priority of Danish Patent Application No. PA 2013 70604, filed Oct. 22, 2013, and Danish Patent Application No. PA 2013 00303, filed May 20, 2013, and which claims the benefit of U.S. Provisional Patent Application No. 61/787,984, filed Mar. 15, 2013. The subject matter of Ser. No. 14/777,325; PCT/EP2014/055307; PA 2013 70604, PA 2013 00303, and 61/787,984 is incorporated herein by reference.

THE PRIOR ART

The present invention relates to an offshore drilling rig comprising a drill deck and a drilling support structure extending upwardly from the drill deck, and where at least one or two work centers are arranged in the drill deck, at least one of the work centers being a primary well center meaning that it is equipped for drillings operations using a diverter that can be connected to a mud return system, such as a marine riser or a mud return conductor being capable of conducting drilling mud from the sea floor to the offshore drilling rig.

Offshore drilling rigs of this kind are expensive to build and operate, and the continued development of this kind of rigs is therefore focused on providing a rig that will reduce the time of production, meaning that the time for drilling and installing the necessary equipment for e.g. oil production shall be as short as possible preferably without significantly increasing the costs of building and operating the rig.

For this purpose many different embodiments of offshore drilling rigs have been proposed during time.

On this background it is in some embodiments the purpose of the present invention to provide an offshore drilling facility that will increase the possibility of operating the rig, even when essential equipment is out of order, e.g. due to maintenance or breakdown.

SUMMARY

In some embodiments of the present invention this is achieved by the rig as mentioned in the introduction further having two hoisting systems (a first and a second hoisting system supported by the drilling support structure and each being adapted for raising or lowering a load carrier (a first and a second load carrier, respectively), and by comprising a positioning system adapted for selectively positioning at least a first load carrier selectively in at least a first or a second position different from the first position, where the first load carrier in the first position is positioned above the primary well center, and in the second position is positioned above the other work center.

Thereby the two hoisting systems may operate over the same work center simultaneously or individually, so that when both hoisting systems are operative it will be possible to use both over the same work center or to use one over a work center and at the same time operating the other hoisting system over the primary well center, or another work center.

This allows that the rig is adapted for different modes of operation, including a dual activity mode where independent operations, such as drilling and standbuilding are simultaneously performed using both the primary well center and the other work center, or in a dual lifting mode where both hoisting systems cooperates for the purpose of lifting heavy loads above one work center, or in a redundancy mode where one hoisting system for some reason is disabled, and the other hoisting system is moved from one position to another in order to replace the disabled hoisting system.

For the purpose of the present description, the term drilling support structure means any construction extending upwardly from the drill deck and being equipped for supporting a hoisting system for hoisting and lowering tubulars (such as drill strings, casings and/or risers towards the seabed) so that drilling into the seabed can be performed. The drilling support structure may extend from the drill deck or from a deck different to the drill deck. The hoisting system is in this relation any system that provides a lifting capacity above one or more of the work centers arranged in the drill deck. This may in one embodiment of the invention be in the form of a hydraulic hoisting system comprising upwardly extending cylinders for supporting the load to be hoisted or lowered typically via cable sheaves mounted on top of the cylinders or alternatively it may be in the form of a conventional draw works system. Examples of a drilling support structure includes a derrick structure which are typically applied to support a draw works hoisting system and a mast structure which are typically applied to support a cylinder hoisting system.

The term work center refers to a hole in the drill deck through which the drilling rig is configured to lower tubular equipment towards the seabed and, in particular, through which tubular equipment may be lowered all the way to the seabed. A work center thus defines a downward passage extending through the drill deck through which tubular equipment may be lowered toward the seabed or even to the seabed. In this respect the term work center covers e.g. a well center, a mousehole, a rathole or a standbuilding foxhole, with or without different tools inserted into or supported from it, such as powerslips or other equipment.

A work center through which the drilling rig is configured to lower tubulars all the way to the seabed and/or through which the drilling rig can perform drilling into the seabed is often referred to as a well center. A well center is sometimes also referred to as a drilling center. It will be appreciated that the drill deck may comprise additional holes such as foxholes and mouse holes that may e.g. be used for building stands of tubulars but through which the drilling rig cannot lower tubulars to the seabed and/or through which the drilling rig cannot perform drilling into the seabed e.g. by lacking a system arranged to rotate a drill string with sufficient force such as a top drive or a rotary table. In some embodiments, a well center comprises a rotary table or a similar device allowing a drill string to be suspended by, or hung off in, the well center; to this end, a well center may comprise power slips or other devices operable to engage tubular equipment and to support the weight of the tubular equipment and, in particular, a string of tubular equipment extending to the seabed, so as to prevent the tubular equipment from descending through the well center. A displaceable well center may comprise a displaceable rotary table or a similar displaceable element comprising a hole and defining a downward passage.

A primary well center is in this relation a well center being adapted for drilling operations comprising a mud return system using e.g. a mud return conduit such as a marine riser typically used with floating drilling rigs or a high pressure riser (also sometime referred to as a conductor pipe) which is typically used on stationary offshore drilling rigs such as jack-ups. In this relation a primary well center is therefore differentiated from other work centers by having a diverter system including a diverter housing arranged below so that drill string passed through the primary well center extends through said diverter housing arranged for diverting e.g. blow outs to one side of the offshore drilling rig. Moreover, the drilling rig comprises a hoisting system, top drive and/or other equipment configured to operate through the primary well center and to perform drilling operations in the seabed. In some embodiments, the drilling rig may comprise a single primary well center or two or even more primary well centers. In addition to one or more primary well centers, the drilling rig may comprise additional work centers and or other additional holes in the drill deck through which the drilling rig cannot progress a drill string through a riser system or another mud return conduit.

The offshore drilling rig may be a semi-submersible drilling rig, i.e. it may comprise one or more buoyancy pontoons located below the ocean surface and wave action, and an operation platform elevated above the ocean surface and supported by one or more column structures extending from the buoyancy pontoon to the operation platform. Alternatively the offshore rig may be of a different type, such as a jack-up drilling rig or a drill ship.

The term tubular equipment is intended to refer to tubular equipment that is advanced through the well center towards the sea floor during one or more stages of the drilling operation. The tubular equipment may be selected from drill pipes and/or other tubular elements of the drill string, risers, liners and casings. Examples of tubular elements of the drill string include drill pipes, drill collars, etc.

For the purpose of this description, the term drill deck is intended to refer to the deck of an operating platform of an offshore drilling rig immediately above which joints of tubulars are assembled to form the drill string which is advanced through the well center towards the seabed. Hence the drill deck is the primary work location for the rig crew and/or machines performing similar functions, such as iron roughnecks. The drill deck normally comprises at least one rotary table for supporting the rotating drill string during drilling operations. For the purpose of the present description, the term drill deck includes the drill floor located directly under/next to the mast and surrounding the well center as well as deck areas on the same level as and connected with the drill floor area by uninterrupted floor area on the same level, i.e. the floor area where human operators and movable equipment such as forklifts, equipment moved on skidbeams, etc. can move around and to/from the well center; in some embodiments without having to climb/descend stairs or other elevations. The drill deck is typically the floor of a platform, e.g. the lowest platform, above the diverter system.

At least parts of the drill deck may be formed by the roof of a housing or enclosure accommodating mud mixing equipment and/or other operational equipment of the drilling rig, thus allowing for a compact and space-saving arrangement of equipment on the drilling rig. For example the drill deck may comprise a storage area for storing pipes, e.g. a storage area for storing pipes in horizontal orientation. The storage area may be located next to the between two horizontal pipe handling devices or, if this is movable, next to the path along which the horizontal pipe handling device may travel. In some embodiments, the pipe storage area and/or horizontal pipe handling equipment may be partially or completely surrounded by open drill deck area, e.g. drill deck area shaped and sized to allow vehicles or skidable items to be moved around the pipe storage area.

While the invention is applicable to rigs with two or more work centers any embodiments described herein may also be applicable where only one work hole is available (or used) with the lifting yokes, hoisting systems or load carriers. In such embodiments the other work center from the primary well center is replaced by the absence of a work center e.g. a blank.

In some embodiments the present invention relates to an offshore drilling rig is therefore proposed comprising two hoisting systems each comprising a lifting cable hanging over at least one cable crown being supported by the drilling support structure and each being adapted for raising or lowering a load carrier, and further comprising a positioning system adapted for selectively positioning each load carrier in a number of different horizontal positions comprising at least a first horizontal position above the primary well center, and a second horizontal position different from the first horizontal position, wherein the positioning system is adapted for positioning each cable crown above said first horizontal position above the primary well center, or said second horizontal position.

In some embodiments the present invention relates to an offshore drilling rig comprising at least one top drive and a positioning system adapted for selectively positioning the top drive in at least a first or a second horizontal position different from the first position, where the top drive in the first position is positioned above the primary well center, and where the offshore drilling rig further comprises a connecting tool being a connecting device having two opposite ends, each being adapted for being directly or indirectly connected to one of the load carriers, and where the connecting tool has an intermediate load carrier arranged between said two opposite ends and being adapted for carrying a load.

Thereby the two hoisting systems may be used simultaneously for providing the combined lifting capacity of each hoisting system in order to lift a load otherwise too heavy for one hoisting system e.g. out of the primary well center.

The hoisting systems may in this relation be any suitable hoisting system such as based on a draw works or a hydraulic cylinder configuration. In this relation the term cable crown covers any device supported by the drilling support structure and being adapted for supporting one or more lifting cables hanging below the drilling support structure beneath the cable crown. This may be in the form of a single cable sheave adapted for supporting one or more cables, or a cluster of cable sheaves being independently rotatable so as to constitute a crown block or a cable sheave cluster e.g. supporting a travelling block beneath the crown block. Furthermore the term load carrier in this relation means any device adapted for being carried by the hoisting system, and allowing a load to be connected to the load carrier. Examples of load carriers may be a load carrying hook, yoke, shackle or a travelling block.

In one embodiment of the present invention, each of the load carriers are connected to a lifting cable hanging from a cable crown (such as a cable sheave cluster or a crown block) supported by the drilling support structure, and the positioning system is adapted for shifting at least one of or each of the cable crown to and from a first and a second horizontal position relative to that cable crown where the load carrier is positioned right above a selected one of the work centers. The position of the cable crown is measured by the position of the load carrier. Also, by each of the cable crowns having at least two positions several configurations are possible including but not limited to the configurations where the rig having two working holes or three holes discussed below where the cable crowns have a common position in the middle and each have a second position to the side. In a configuration with two holes one or both cable crowns may be arranged to be positioned over both holes so that one can replace the other for redundancy and/or the load carriers may be arranged to lift together in one of the work holes.

The drilling rig may further comprise a connecting tool having two opposite ends each being adapted for directly or indirectly connecting it to one of the load carriers, so that the connecting tool can be carried by two different load carriers, and where the connecting tool has an intermediate load carrier being arranged between said two opposite ends and being adapted for carrying a load. In this way, it is possible to mount the connecting tool so that it is hanging below and between two load carriers, and thereby it is possible to provide a lifting power being higher than the lifting power of each of the hoisting systems by using both hoisting systems to lift the same load via the connecting tool.

In this relation, the positioning system may advantageously further be adapted for shifting each of the two cable crowns to a position right next to the first position, and so that the two load carriers are positioned on opposite sides of the first position.

Furthermore, the positioning system may advantageously comprise a retractable dolly arranged for each load carrier, and the retractable dolly being adapted to connect the load carrier to a vertically extending track preferably mounted on the drilling support structure, and to position the load carrier in the first and the second horizontal position above e.g. two different work centers and being adapted for positioning the load carrier at a distance from the track, so that it is positioned right above one of the work centers. In order to enable this function in practice it will be recognized that the retractable dolly may be adapted to reach a load carrier at a substantial horizontal distance from the vertically extending track, even where such a distance exceeds 4 or even 5 meters, such as exceeds 6 or even 7 meters, such as exceeds 8 or even 9 meters, such as exceeds 10 or even 11 meters, such as exceeds 12 or even 15 meters.

Especially in relation to rigs having a very large distance between the work centers, such as the above mentioned 10 meters the requirement to the reach provided by the retractable dolly is substantial. As such large dollies are not practical to operate fir different reasons, but also because it is expensive to implement dollies providing a substantial reach, then the offshore drilling rig may advantageously comprise at least three work centers arranged in the drill deck horizontally spaced apart from each other's in mutually different distances from the vertically extending track. Thereby it is still possible to provide the redundancy and increased lifting capacity even if the reach provided by retractable dolly connecting the top drive to the vertically extending track may be reduced so that it only allows the top drive to be vertically aligned above the two of the three work centers being closest to the vertically extending track.

In order to reduce the horizontally induced load on the retractable dolly it is in this relation preferred that the cable crown carrying a load carrier, and the retractable dolly connecting the same load carrier to said vertically extending track are adapted to keep the lifting cable between the cable crown and the load carrier substantially vertical.

It is understood that variations of the present invention may be made by applying a retractable dolly. Firstly, in some embodiments the retractable dolly comprises a load carrier for carrying loads extending into the work hole and the load carrier of the cable connected to the hoisting system is connected to the retractable dolly for providing vertical lifting power to the dolly. In combination of alternatively, the retractable dolly may be provided to offset the load carrier connected the cable from the position it would have based on the position of the cable crown and no retractable dolly. Typically, it is advantageous if these two positions are substantially aligned so the lift provided by the hoisting system via the cable is substantially vertical. However, by providing such offset via the dolly less movement may be necessary of the cable crown which may be a faster and/or simpler way of changing position of the load carrier. Accordingly, in some embodiments the position of the cable crown refers to the position of the load carrier as provided by the cable crown and the dolly in combination. In some embodiments the position of the cable crown refers to the position of the load carrier as it would have been without a retractable dolly influencing the horizontal position.

In another preferred embodiment the two work centers are mounted in a substantially horizontal track in the drill deck, and the drill deck comprises a work center positioning system adapted for selectively moving at least one of or each of the work centers in the horizontal track to the first or the second position in the drill deck.

In this relation the horizontal track may preferably be linear at least along a part of it, and the diverter system may comprise at least one diverter over board tube having a first end being connected to the primary well center and the other end being supported and fixed with respect to the drill deck and having at least one telescopic section between the first and the second end, the telescopic section extending parallel to linear part of the horizontal track in the drill deck. Thereby the diverter over board tube, which may be directing well fluids under high pressure from the diverter and over board, is relatively easy to keep tight during drilling operations e.g. by using a hydraulic, pneumatic or mechanical packer to tighten and seal the telescopic section during drilling operations.

The drilling rig may advantageously further comprise at least one riser tensioning arrangement below the drill deck, and where the riser tensioners are mounted on linear tracks for repositioning, and in parallel to the horizontal track in the drill deck, so that the riser tensioners can be positioned below either of the work centers and/or below either of the first or second positions.

In some embodiments each load carrier is lifting a top drive, which in some embodiments is considered a load carrier itself.

In a further preferred embodiment, two work centers may both be primary well centers comprising a rotary table and a diverter system arranged in the drill deck.

In yet a further preferred embodiment, the shifting means is adapted for shifting each of the cable crowns along a line being parallel to the linear part of the horizontal track in the drill deck.

In the context of this description the terms of moving, positioning, skidding shifting and so on is meant to include the process of displacing a component or part from one position to another, but also the necessary means for holding or fixing the component or part at a selected position during operation of the drilling rig.

THE DRAWING

In the following one or more embodiments of the invention will be described in more detail and with reference to the drawing, where:

FIGS. 1*a* and 1*b*: Are concept drawings showing two different operation situations of a dual activity drilling facility seen from one side, incorporating full redundancy for the intended drilling operation by incorporating skidding well centers/work center in the drill deck.

FIGS. 2*a* and 2*b*: Are concept drawings showing two different operation situations of a cyclic operating hoisting system within the same drilling facility seen from one side, enabling both hoisting systems to work over the same work center individually or in turn for providing fast tripping of drill pipe, casing running or riser- and BOP running/retrieval operation.

FIG. 3: Is a concept drawing showing an alternative embodiment of the invention, where each hoisting system comprises a cable winch.

FIG. 4: Is a concept drawing showing an operation mode where the two hoisting systems are operated synchronously within the same drilling facility seen from one side, enabling both hoisting systems to work over the same work center in sync for providing a combined lifting capacity in the one work center.

FIG. 5: Is a concept drawing showing an operation mode where the two hoisting systems are operated synchronously within the same drilling facility seen from one side, enabling both hoisting systems to work over the same work center in sync for providing a double lifting capacity in the one work center, but with only one hoisting system carrying a top-drive, and with a single work center.

FIG. 6: Is a concept drawing showing a transferable diverter housing and mud return tubing system with telescoping diverter overboard lines according to the invention, seen from below.

FIG. 7: Is a sectional drawing showing a cross section through the center of a primary well center in the form of a rotary table supported on a transferable skidbase on tracks arranged in the drill deck, with a diverter housing suspended from underneath the said transferable skidbase and with a riser supported by in-line hydraulic riser tensioners mounted on a separate tracks below the drill deck.

FIGS. 10-18 illustrate another embodiment of an offshore drilling rig, wherein FIG. 10 shows a side view of the drilling rig, FIGS. 11-14 show 3D views of parts of the drilling rig from different viewpoints, FIGS. 15-16 show horizontal cross-sectional views of the drilling rig, and FIGS. 17-18 show lateral cross sections of the drilling rig.

DESCRIPTION OF EXEMPLARY EMBODIMENTS

Figure 1A:
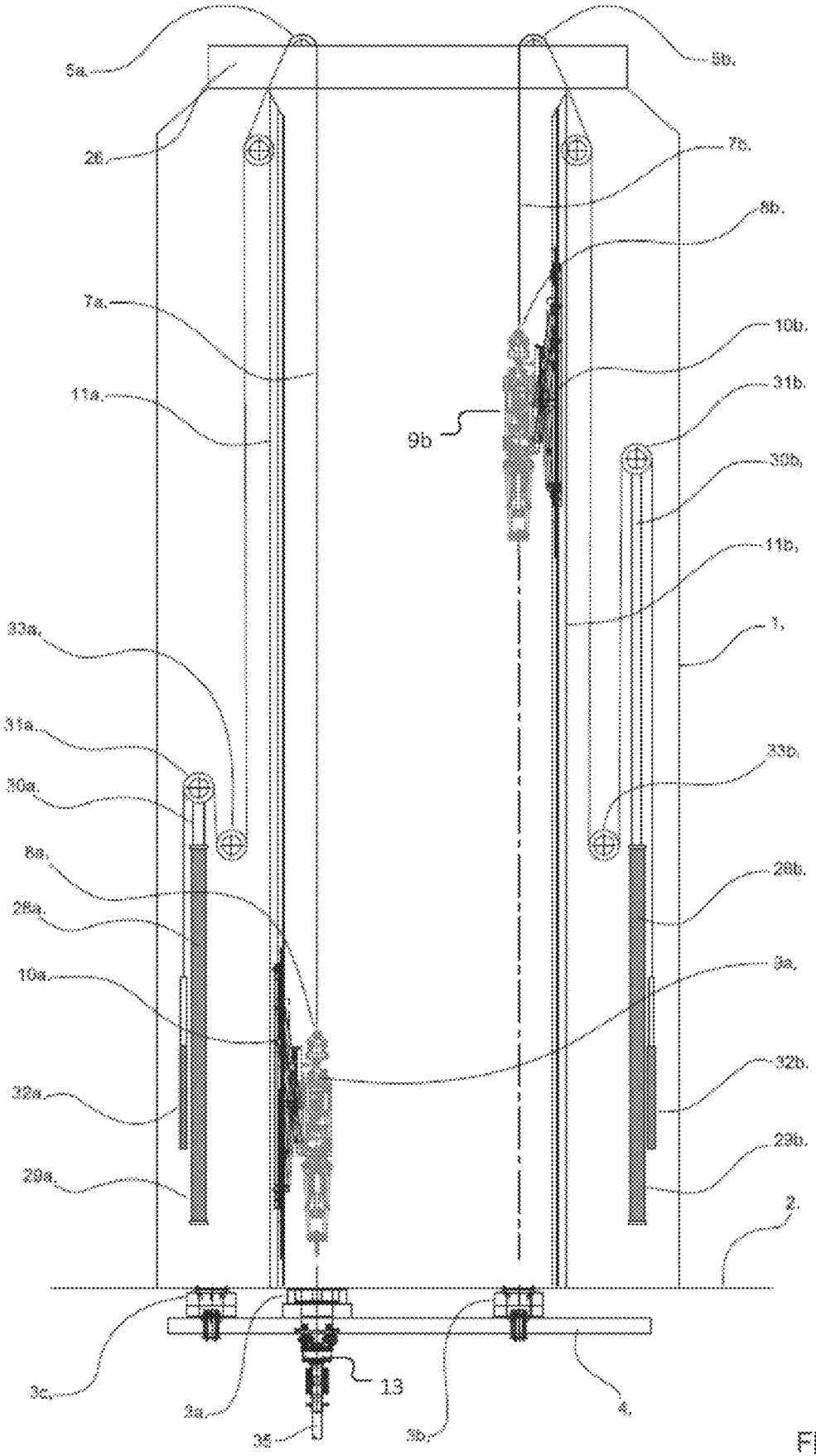

FIGS. 1*a*, 1*b*, 2*a*, 2*b* and 4 all shows a drilling support structure 1 arranged above a drill deck 2 and three work centers 3*a*, 3*b* and 3*c*, where one is in the form of a primary well center 3*a* being equipped with a diverter housing 13. The three work centers 3*a*, 3*b* and 3*c* are supported on individual skidbases on tracks 4 arranged in the drill deck 2, and the drilling support structure 1 carries two cable crowns 5*a* and 5*b* on FIGS. 1*a*, 1*b*, 2*a*, 2*b* and 4 in the form of a crown sheave cluster, and on FIG. 3 in the form of a crown block, being skidably arranged on the top of the drilling support structure 1 on separate tracks.

From each of the crown sheave clusters 5*a* and 5*b* lifting cables 7*a* and 7*b* are running down and connecting to a load carrier 8*a* and 8*b* each carrying a top drive 9*a* and 9*b* at the end of the lifting cables 7*a* and 7*b*. Each of the top drives are connected via a retractable dolly 10*a* and 10*b* to a vertical track 11*a* and 11*b* arranged at the drilling support structure 1. The retractable dollies 10*a* and 10*b* are each adapted so that they can position and keep the top drives in different positions above the work centers 3*a*, 3*b*, 3*c* in the drilling deck 2.

In the embodiment shown on FIGS. 1*a*, 1*b*, 2*a*, 2*b*, and 4 each hoisting system has a linear actuator in the form of a hydraulic cylinder 28*a*, 28*b*, having its lowermost end 29*a*, 29*b* fixed with respect to the drill deck 2 and an upper travelling end 30*a*, 30*b* with a cable sheave 31*a*, 31*b*. At least one lifting cable 7*a*, 7*b* has one end extending from another hydraulic cylinder 32*a*, 32*b* arranged for compensating heave during e.g. drilling operation, and over the travelling cable sheave 31*a*, 31*b* and further below a second cable sheave 33*a*, 33*b* being fixed with respect to the drilling support structure 1, and thereafter over the crown sheave cluster 5*a*, 5*b*. skidably mounted on the drilling support structure 1 on a track 26. In these figures only a single lifting cable is shown for each hoisting system, but in practice it is necessary in order to provide significant lifting capacity, as well as redundancy in case that one cable breaks, to have multiple mutually parallel lifting cables extending along with the lifting cables 7*a*, 7*b*.

Figure 3:
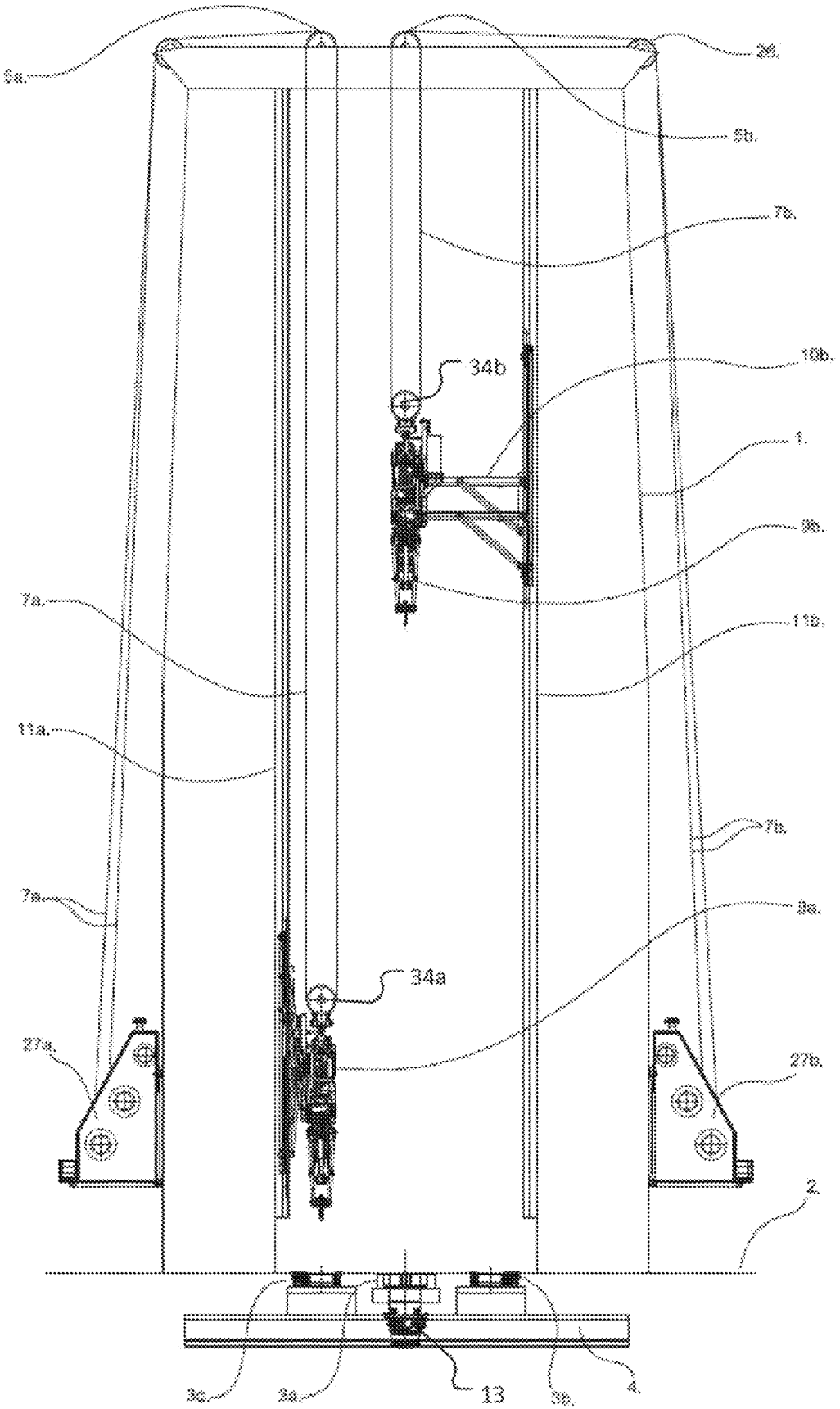

Alternatively the drilling support structure 1 shown on FIG. 3 has a hoisting system with two cable crowns 5*a*, 5*b* each in the form of a crown block being connected to a travelling block 34*a*, 34*b* via multiple cable loops hanging down from the crown block 5*a*, 5*b*, In this embodiment each travelling block is carrying a topdrive 9*a*, 9*b*. In this embodiment a single lifting cable 7*a*, 7*b* is providing the multiple cable loops, and thereby the necessary cable lifting capacity of the hoisting system, and therefore, in order to provide the necessary travelling length of the travelling block, a cable winch 27*a*, 27*b* is arranged for each hoisting system.

The embodiment shown in FIG. 3 shows a dual cable winch 27*a*, 27*b* system for each of the two hoisting systems for providing better hoisting speeds and for adding redundancy to the active heave compensating winches. However, one of the cable winches on each or both of the two hoisting systems may be replaced by a deadline compensating system (not shown in FIG. 3) at the dead end of the lifting cables 7*a*, 7*b*, so that it is not necessary to use the cable winches 27*a*, 27*b* for heave compensation.

The skilled person will, however, appreciate that the mere combination of the skidable crown sheave clusters 5*a*, 5*b* shown on FIGS. 1*a*, 1*b*, 2*a*, 2*b* and 4 and the linear actuators 28, disregarding other features of the present invention, mutatis mutandis, provides both an efficient and safe lifting capacity, because each hoisting system may comprise multiple lifting cables 7*a*, 7*b* extending parallel to each other's in order to carry the same load carrier 8*a*, 8*b* or the same topdrive 9*a*, 9*b*.

For the same reason each cable winch 27*a*, 27*b* shown in FIG. 3 may therefore comprise more than one cable drums arranged on the same axle, and each drum containing a cable so that two or more cables may be arranged parallel to each other, and so that one cable winch 27*a*, 27*b* simultaneously rotates all cable drums and thereby wind or unwind all the cables simultaneously. Thereby the hoisting system comprises multiple lifting cables 7*a*, 7*b* extending parallel to each other's in order to carry the same travelling block, or the same topdrive 9*a*, 9*b*. thereby a similar cable redundancy is obtained with the cable winch based hoisting system shown on FIG. 3 as is the case with the hoisting systems described in relation to the embodiments shown on FIGS. 1*a*, 1*b*, 2*a*, 2*b*, and 4.

Figure 4:
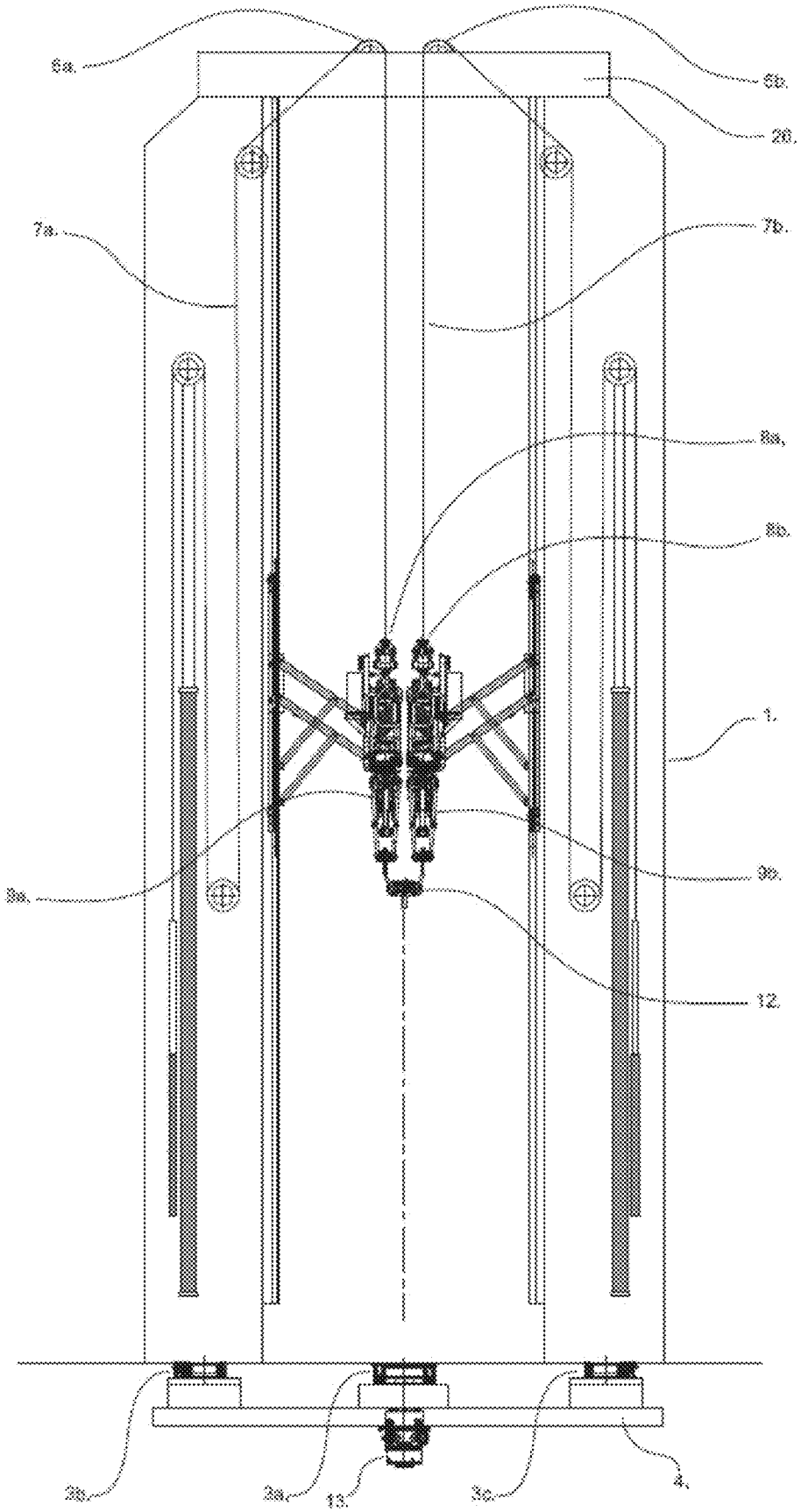
Figure 5:
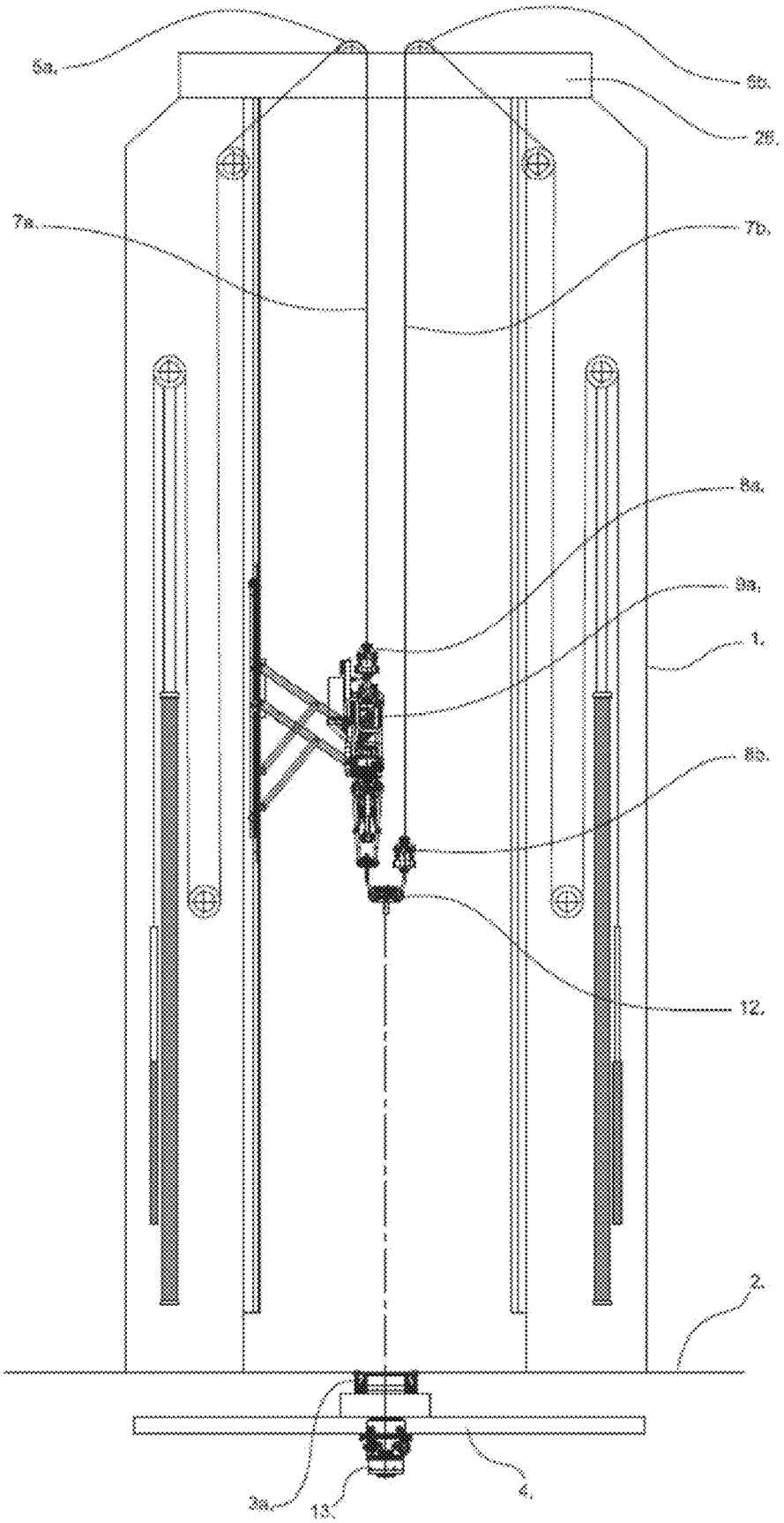

In FIGS. 4 and 5*a* connecting tool 12 is connecting the load carriers 8*a* and 8*b* via the top drives 9*a* and 9*b* in FIG. 4 and a single topdrive 9*a* in FIG. 5. Thereby it is possible to connect a load to the connecting tool 12, so that it is possible to provide a lifting force by combining the lifting force of both hoisting systems lifting the two load carriers 8*a* and 8*b*.

Figure 6:
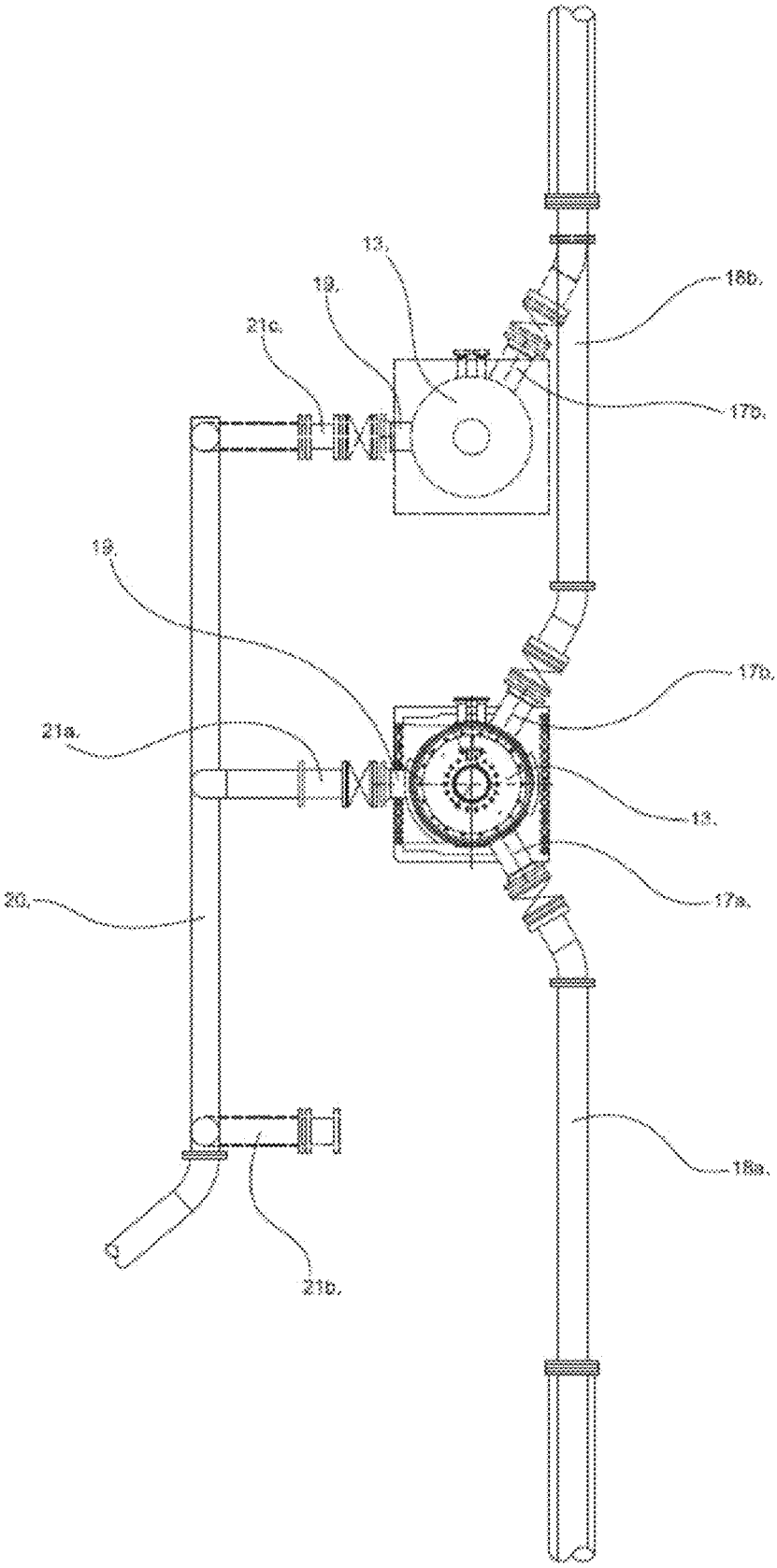
Figure 7:
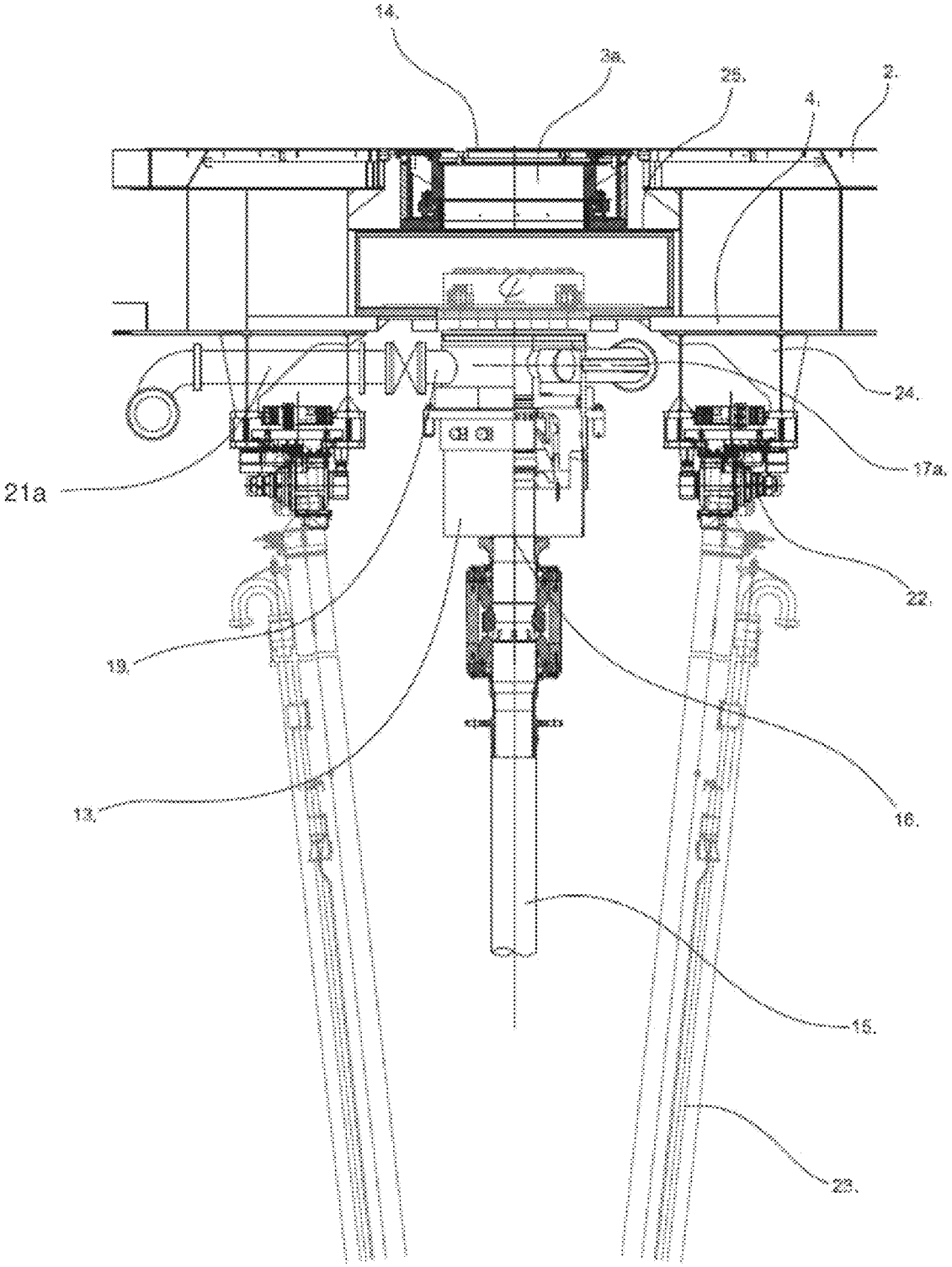

FIG. 6 shows the conceptual layout of a preferred embodiment of a diverter system attached to the primary well center 3*a* such as it is shown on FIG. 7.

This diverter system comprises a diverter housing 13 suspended from the skidbase 25 and supporting the rotary table 14 of the primary well center 3*a*.

The diverter housing 13 has at least two outlet ports 17*a* and 17*b* each being connected to telescopic overboard lines 18*a* and 18*b*. This allows the diverter housing 13 to be positioned at different positions along a line defined by the track 4 being parallel to the overboard lines. One such position is shown in FIG. 6 in full line, and another is shown with dotted lines.

The diverter housing 13 also comprises a mud return outlet port 19 adapted for leading drilling mud from the diverter housing back to the mud process systems via the main mud return line system 20. The mud return line comprises a number of telescopic connectors 21*a* 21*b* and 21*c* arranged at selected positions in order to connect the mud return line to the mud return outlet port 19 on the diverter housing 13.

In FIG. 7 a primary well center 3*a* is shown I more detail comprising the above mentioned components and parts, and in this figure a riser tensioner system is also shown comprising skidding carriages 22 and hydraulic in-line tensioning cylinders 23 being skidably supported by a separate riser tensioner track 24 arranged parallel to and below the track 4 supporting the rotary table skidbase 25. Thereby the riser tensioners 23 may be moved along with the rotary table and diverter housing 13 or independently of the rotary table 14 and diverter housing 13.

In the following different modes of operating the drilling rig shown in the figures are disclosed in more detail with reference to the relevant figures.

Figure 1B:
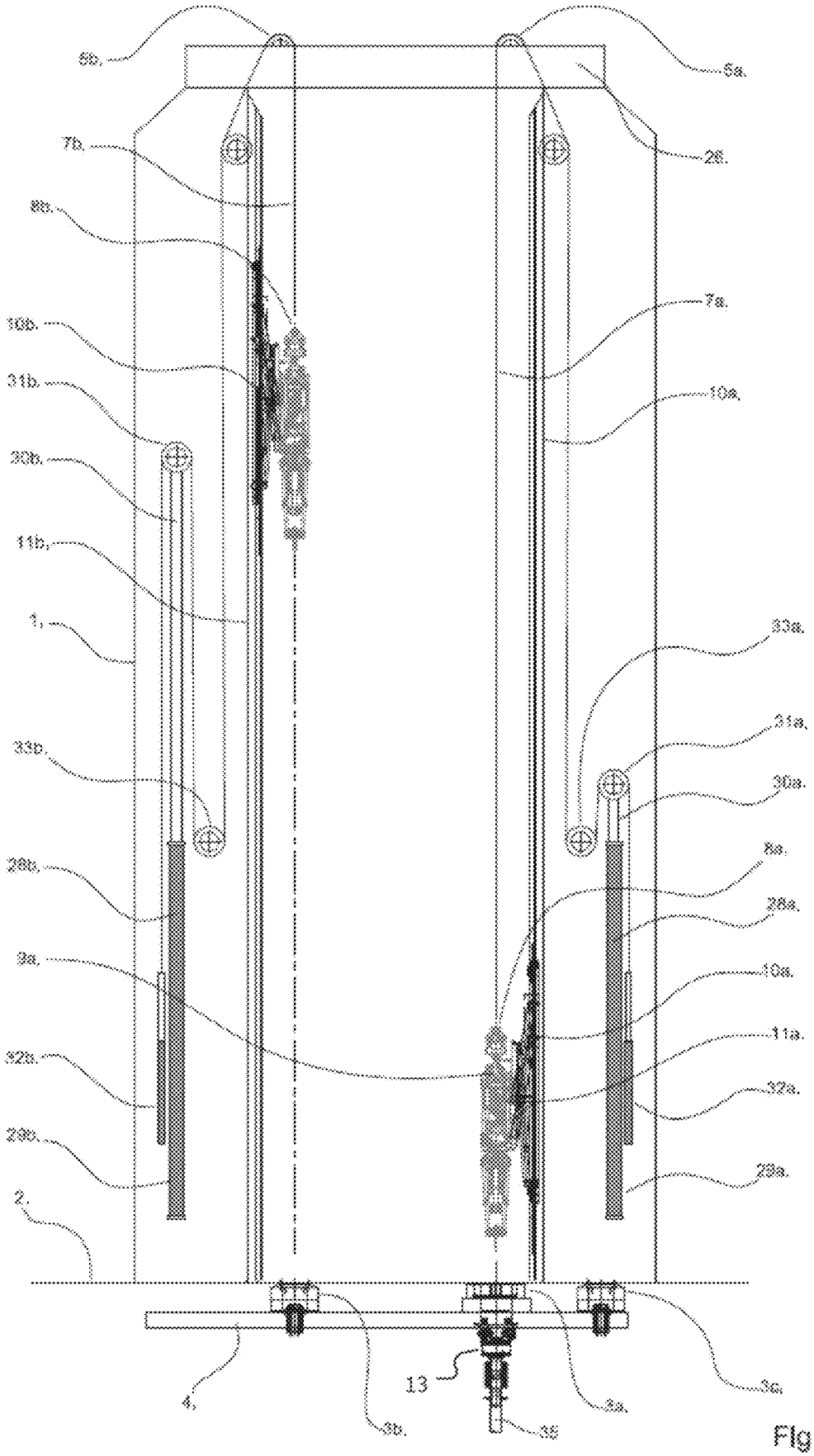

1. Full redundancy:

With reference to FIGS. 1*a* and 1*b* especially, but not only, a fully redundant dual activity hoisting- and drilling facility is provided.

Full redundancy is achieved by having a transferable, riser-capable primary well center 3*a*, which may be positioned under either one of the top drives (e.g. 9*a* or 9*b*) and load carriers (8*a* and 8*b*) of the two fully rated main hoisting- and drilling systems comprising the facility. In this relation the primary well center may be transferred and positioned as mentioned above, with or without one tubular or a string of tubulars 35, such as riser tubes, casings, drilling pipes or the like being supported and/or hanging down from the primary well center, and these tubulars may be either hanging freely down from the primary well center, or they may extend all the way to the sea floor and further extend into the well or be connected to the well at the sea floor. In the latter case a diverter system and a tensioning system as shown on FIGS. 6 and 7 respectively may be employed along with other well control equipment.

The riser-capable primary well center 3*a* shall consist of a rotary table 14 supported by a horizontally transferable skid/trolley 25 that is sunk into a slot in the drill deck 2, so that the rotary table 14 top cover is substantially flush with the drill deck 2 level.

The transferable skid/trolley 25 shall be resting on horizontal skid beams forming a track 4 spanning the width between the two fully rated main hoisting- and drilling systems 9*a* and 9*b*.

A diverter housing 13 with telescoping overboard lines (overboard tubing 18*a* and 18*b*) and a detachable main flowline (mud return tubing 20) shall be suspended from underneath the said transferable skid/trolley 25.

A transferable/skidding riser tensioning system shall be arranged on horizontal skid beams suspended from underneath the drill deck structure, while spanning the full width between the two fully rated main hoisting- and drilling systems.

Following examples are given for the intended operation to ensure full redundancy e.g. in the case that the one (active) fully rated main hoisting- and drilling system suffers a main equipment breakdown:

1. While drilling, tripping drill pipe or running casing during the riserless tophole sections of the well.
   - 1.1 the drillpipe or casing string is hung off in the power-slips/casing-spider
   - 1.2 the drillpipe or casing string, while being suspended from the power-slips/casing-spider inside the rotary table, will be transferred to the opposite fully rated main hoisting- and drilling system
   - 1.3 drilling, tripping drill pipe or casing running operation may resume on the opposite fully rated main hoisting- and drilling system
2. while running or retrieving riser and BOP
   - 2.1 the riser string and BOP is lowered and hung-off in the riser spider and gimbal, which is resting on top of the rotary table.
   - 2.2 the riser string and BOP, while being suspended from the riser spider and gimbal, will be transferred to the opposite fully rated main hoisting- and drilling system
   - 2.3 running of the riser may resume on the opposite fully rated main hoisting- and drilling system
3. while drilling, tripping drill pipe or running casing through the riser and BOP after this has been connected to the well and the riser has been put in tension
   - 3.1 the drillpipe or casing string is hung off in the power-slips/casing-spider
   - 3.2 the well is secured
   - 3.3 the drillpipe or casing string, while being suspended from the power-slips/casing-spider inside the rotary table, will be transferred to the opposite fully rated main hoisting- and drilling system
   - 3.4 the diverter housing with telescoping overboard lines and detachable main flowline, suspended from below the transferable skid/trolley supporting the rotary table, will be transferred to the opposite fully rated main hoisting- and drilling system
   - 3.5 in fully synchronous motion, the riser string, while being suspended from the riser tensioners will be transferred to the opposite fully rated main hoisting- and drilling system
   - 3.6 drilling, tripping drill pipe or casing running operation may resume on the opposite fully rated main hoisting- and drilling system The fully redundant dual activity hoisting- and drilling facility illustrated in FIGS. 1*a* and 1*b* will allow for continued operation on either port or starboard side hoisting- and drilling system (by repositioning of the primary well center), while the opposite side is decommissioned for any extended period of time, e.g. for Class required Special Periodic Survey, breakdown or other reason.

Figure 2A:
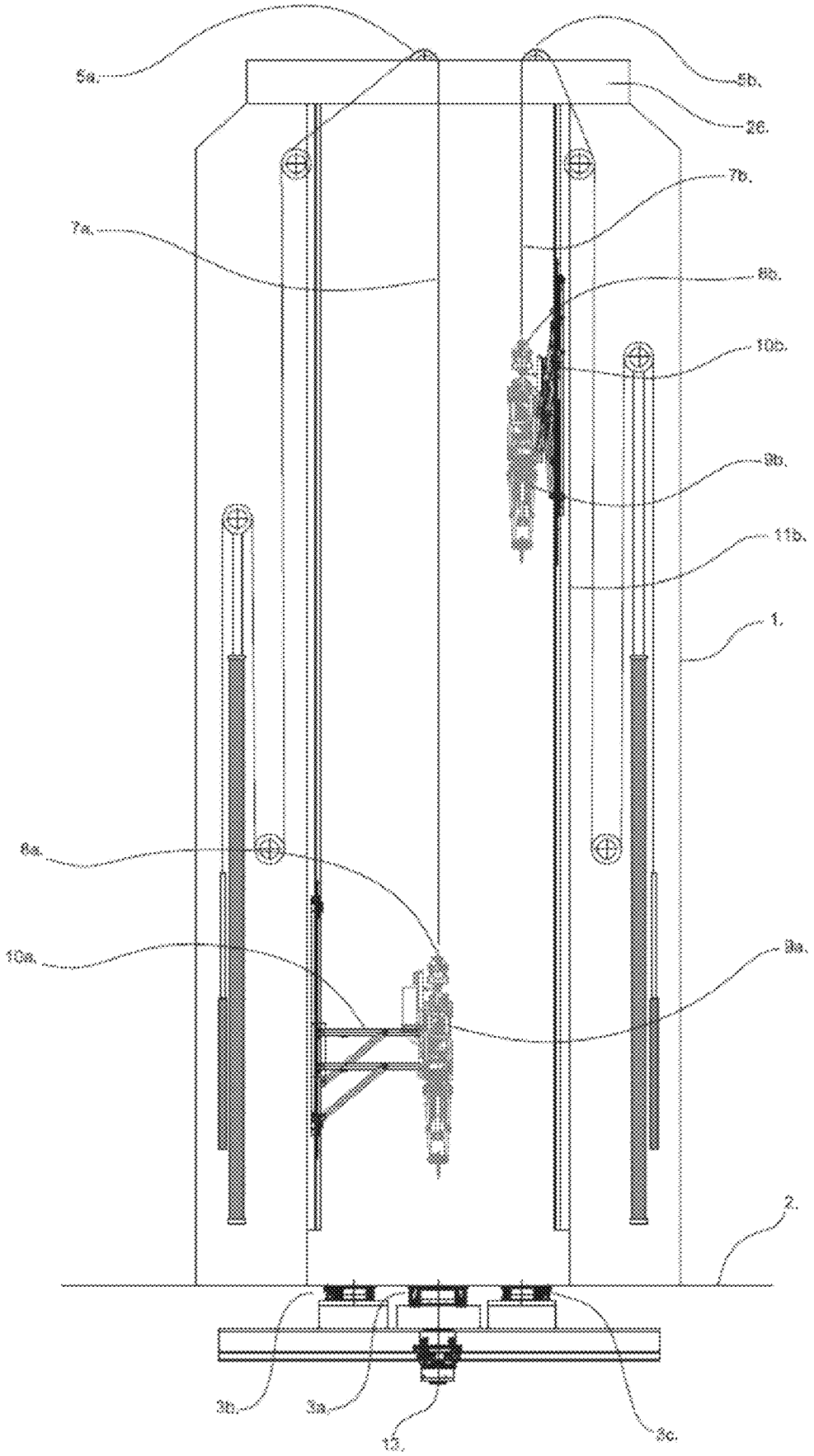
Figure 2B:
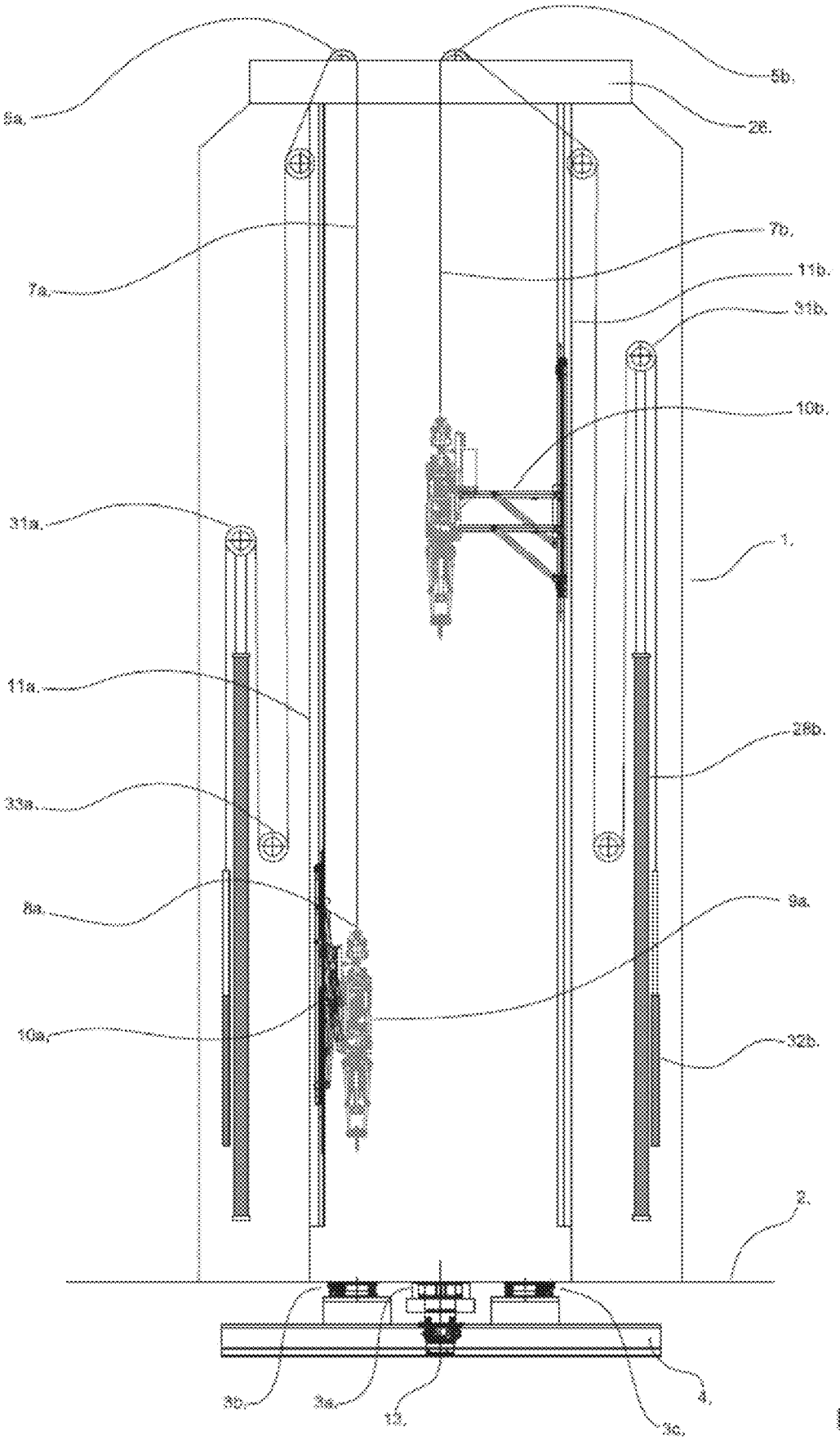

2. Cyclic Dual Hoisting:

With reference to FIGS. 2*a* and 2*b* especially, but not only, a cyclic dual hoisting facility is provided especially for Fast Tripping, Casing- or Riser Running:

Fast tripping, casing- or riser running operation is ensured by having two independent and fully redundant hoisting- and drilling systems (top drives 9*a* and 9*b*) working in cyclic operation over a common primary well centre 3*a*.

Each hoisting and drilling system shall consist of a main hoisting system with a horizontally transferable cable crown in the form of a crown sheave cluster arrangement 5*a*, 5*b*, allowing the crown sheave cluster 5*a*, 5*b* to be horizontally transferred, aligned and locked into position over at least two independent positions/well centers 3*a*, 3*b*, 3*c* on the drill deck 2 below.

Each hoisting system supports a vertically travelling load carrier 8*a*, 8*b* arrangement, from which a topdrive 9*a*, 9*b* is suspended below on a horizontally extend-/retractable dolly 10*a*, 10*b* system for guiding of the topdrive 9*a*, 9*b*.

The extend-/retractable dolly 10*a*, 10*b* shall have a horizontal travel corresponding with the horizontal travel of the crown sheave cluster 5*a*, 5*b* arrangement above, while extending/retracting horizontally in synchronous motion with the skidding crown sheave cluster 5*a*, 5*b* arrangement above, ensuring that the hoisting system is kept in true vertical alignment with the cable sheave cluster/load carrier/yoke/hook arrangement and the topdrive 9*a*, 9*b* suspended underneath it.

In the following typical examples are given for the intended cyclic operation of the dual hoisting and drilling facility to provide fast tripping, casing or riser running operation:

1. Tripping/running in the hole: low setback and pipe racking system off-drill deck.

2. Tripping/running in the hole: setback and pipe racking system on-drill deck.

Fast running or retrieval of the riser and BOP may be performed in a similar cyclic operation, while employing suitable arrangements for facilitating handling of the riser joints to/from the primary well centre 3*a* with this being in the center position An added benefit of the invention is the full redundancy provided within this facility in that each hoisting and drilling system will offer full redundancy for the other system in the center operating position, without repositioning of the primary well centre 3*a*.

3. Synchronous Dual Hoisting:

With reference to FIG. 4 especially, but not only, a synchronous dual hoisting facility is provided for heavy duty well construction.

The synchronous hoisting facility is realized by utilizing the two independent and fully redundant hoisting- and drilling systems in a combined synchronous mode of lifting operation above the common primary well center 3*a*, by using a connecting tool 12.

In FIG. 4 the synchronously hoisting facility comprises two topdrives, but as shown in FIG. 5 it is possible to operate the hoisting systems synchronously even when only one topdrive 9*a* is used. In this situation the connecting tool 12 is carried by the topdrive 9*a* on one side, but is directly connected to the hoisting cable via the load carrier 8*b* at the other side.

This principle allows for extra heavy duty lifting operation without necessitating any of the two hoisting- and drilling systems to be rated beyond the current design loads of such equipment, where especially the load capacity of the topdrives 9*a*, 9*b* are limiting the load capacity of the hoisting systems.

Recurring requests for rigs capable of running extended sections of heavy wall casing strings through deep formations in ultra-deep water may require lifting facilities of 1500 metric tons SWL or beyond.

Current designs of hoisting and drilling systems are limited to approx. 1200 metric tons only, with systems and equipment currently under design and development for up to 1500 metric tons.

Consequently, the next generation of DW drilling rigs may only provide incrementally larger hoisting capacity compared with the current generation of rigs and will therefore restrict well designs to within the 1500 metric tons limit of the next generation of top drives.

However, this invention will allow for hoisting and lowering loads exceeding 2000 metric tons, limited only by the structural integrity and load carrying capacity of the casing and landing string tubulars, running- and handling tools.

A generic ultra-deep subsalt and/or HPHT well development program in ultra-deep water might utilize all aspects of the invention to their full potential through the following steps and transitions between modes of operation:

1. Dual activity operation for concurrently drilling top-hole sections, while running and cementing casing down to and including the 18" casing section.

2. Dual activity operation for concurrently running riser and BOP, while cementing the 18" casing section, incorporating full redundancy.

3. Transferring the primary well center 3*a* with riser and BOP suspended to the center position with subsequent landing of the BOP.

4. Drilling, tripping and running casing in cyclic operation through riser with primary well center 3*a* in center position 5. Running and landing extra-long heavy casing sections in synchronous dual hoisting mode FIG. 8 is a concept drawing showing a drill ship adapted for dual activity operation, and having a first and a second hoisting system supported by the drilling support structure 1, the first hoisting system and each being adapted for raising or lowering a first load carrier, and the second hoisting system being adapted for raising or lowering a second load carrier, respectively.

A top drive 9*a*, 9*b* is suspended from each of the load carriers, and the offshore drilling rig comprises a positioning system adapted for selectively positioning at least the one load carrier or the primary well center selectively in at least a first or a second horizontal position different from the first horizontal position, where the first load carrier in the first horizontal position is positioned above the primary well center, and in the second horizontal position is positioned above the other work center.

Figure 8:
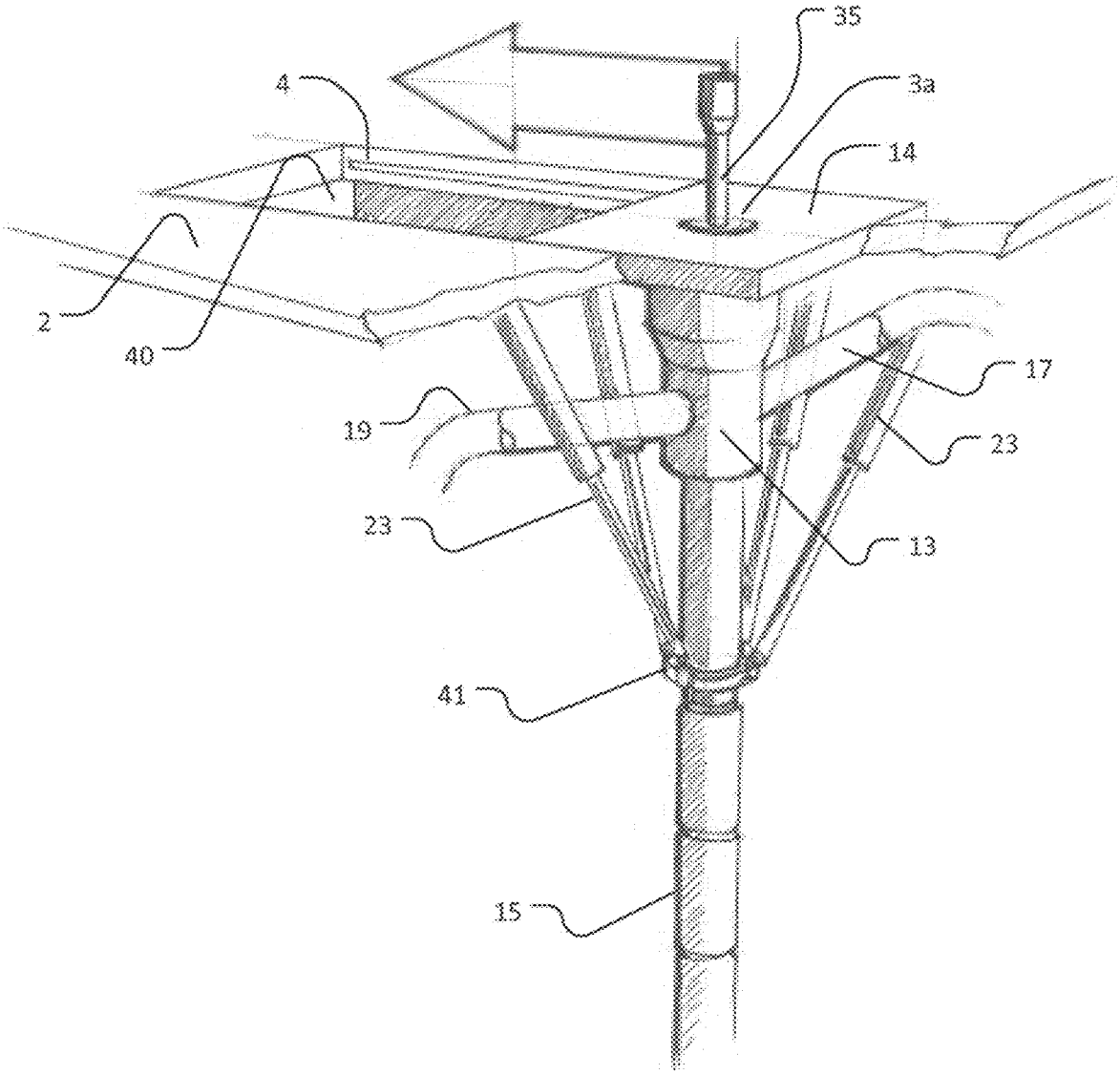
FIG. 8 is a concept drawing showing a transferable primary well centre, diverter system and riser tensioning system.

In particular, FIG. 8 shows a part of the drill deck 2 including a displacable primary well center 3*a*. The well center is defined by hole of a rotary table 14 that is skidable along tracks 4 in the drill deck. In the example of FIG. 8 the rotary table has a top surface that is flush with the upper surface of the drill deck, and the drill deck defines a slot 40 having a width matching the size of the rotary table. In other embodiments, the slot may be narrower, e.g. by letting the drill deck surface extend partially across the rotary table. Alternatively or additionally, the slot 40 may be covered by plates or hatches which may be removed during the skidding of the well centre. The drilling rig of FIG. 8 further comprises a diverter system comprising a diverter housing 13 from which outlet ports 17 and 19 extend. The diverter housing is mounted below the well centre 3*a* and arranged to be skidable together with the well center 3*a*. For example, the diverter housing may be suspended from a skidbase supporting the rotary table, as described in connection with FIG. 6 above. The drilling rig of FIG. 8 further comprises a riser tensioning system comprising hydraulic in-line tensioning cylinders 23 being skidably supported by a separate riser tensioner track (not explicitly shown in FIG. 8) arranged parallel to the track 4 supporting the rotary table 14, e.g. as described in connection with FIG. 6. Thereby the riser tensioners 23 may be moved along with the rotary table and diverter housing 13. The riser tensioning cylinders are, at their lower end, connected to a tensioner ring 41 which engages a marine riser string 15 so as to control the tension on the riser string. In the example of FIG. 8, the rotary table 14, the diverter housing 13 and the riser tensioners 23 with the riser string 15 suspended from it may individually or jointly be skidded in the direction indicated by an arrow in FIG. 8. As is further illustrated in FIG. 8, the above components may even be jointly skidded while a string of pipe 35 is suspended in the rotary table 14 and extends downward through the riser 15.

Generally, a skidable arrangement of equipment allows the displacement, in particular horizontal displacement, of the equipment, e.g. guided by tracks or similar guide means.

Figure 9:
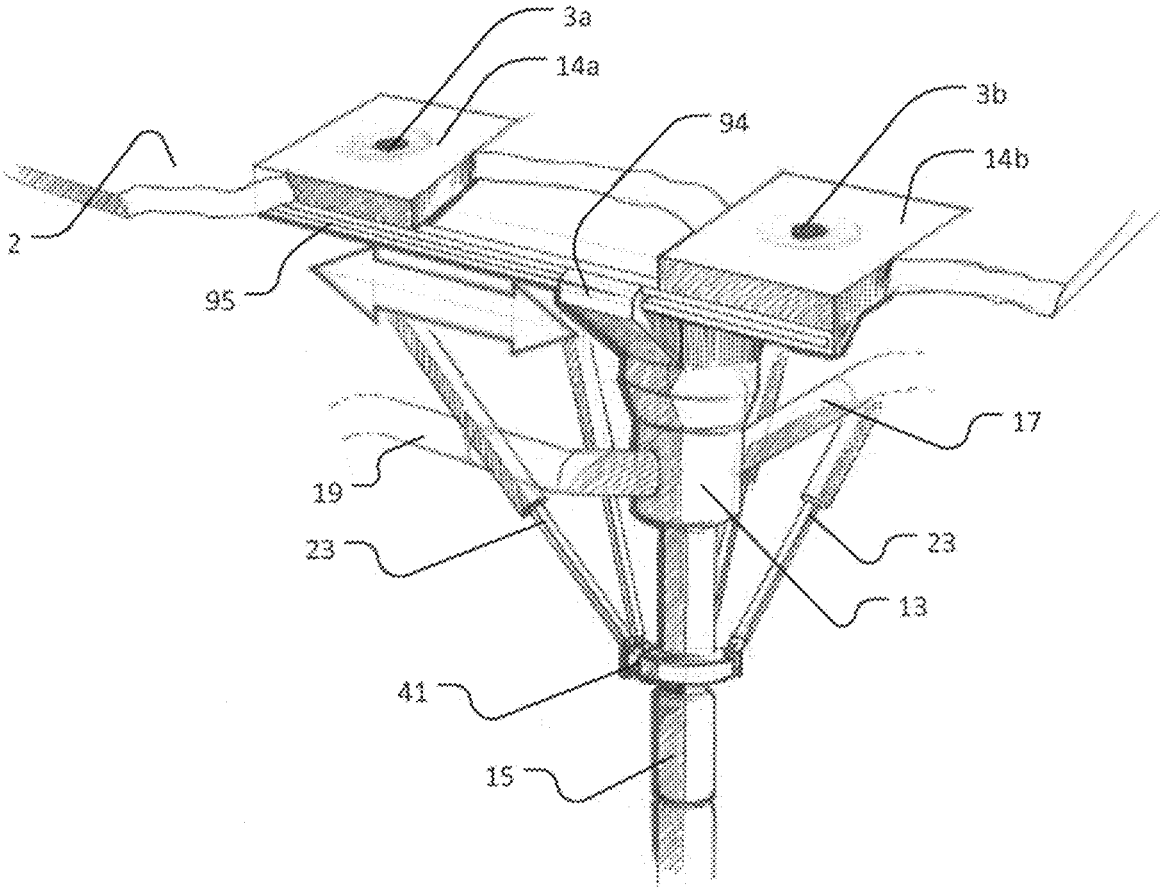
FIG. 9 is a concept drawing showing a transferable diverter system and riser tensioning system.

FIG. 9 is a concept drawing showing a transferable diverter system and riser tensioning system. In the example of FIG. 9, the drilling rig comprises two stationary rotary tables 14*a,b*, each defining a work center 3*a,b*, respectively, that is operable as a primary well center. The drilling rig of FIG. 9 further comprises a diverter system comprising a diverter housing 13 from which outlet ports 17 and 19 extend. The diverter housing is mounted below the drill deck 2 and arranged to be skidable along tracks 95 extending between the rotary tables 14*a,b*. To this end, the diverter housing comprises carriages 94 movably attached to the tracks 95. The drilling rig of FIG. 9 further comprises a riser tensioning system comprising hydraulic in-line tensioning cylinders 23 being skidably supported by a separate riser tensioner track (not explicitly shown in FIG. 8) arranged parallel to the track 94 that supports the diverter housing 13, e.g. as described in connection with FIG. 6. Thereby the riser tensioners 23 may be moved along with the diverter housing 13 between positions under the respective work centers 3*a,b*. The riser tensioning cylinders are, at their lower end, connected to a tensioner ring 41 which engages a marine riser string 15 so as to control the tension on the riser string. In the example of FIG. 9, the diverter housing 13 and the riser tensioners 23 with the riser string 15 suspended from it may jointly be skidded in the direction indicated by an arrow in FIG. 9. Consequently, the work centers may selectively be operated as primary well center so as to obtain an increased redundancy, e.g. in case of a failure of a hoisting system that operates above one of the work centers.

Figure 10:
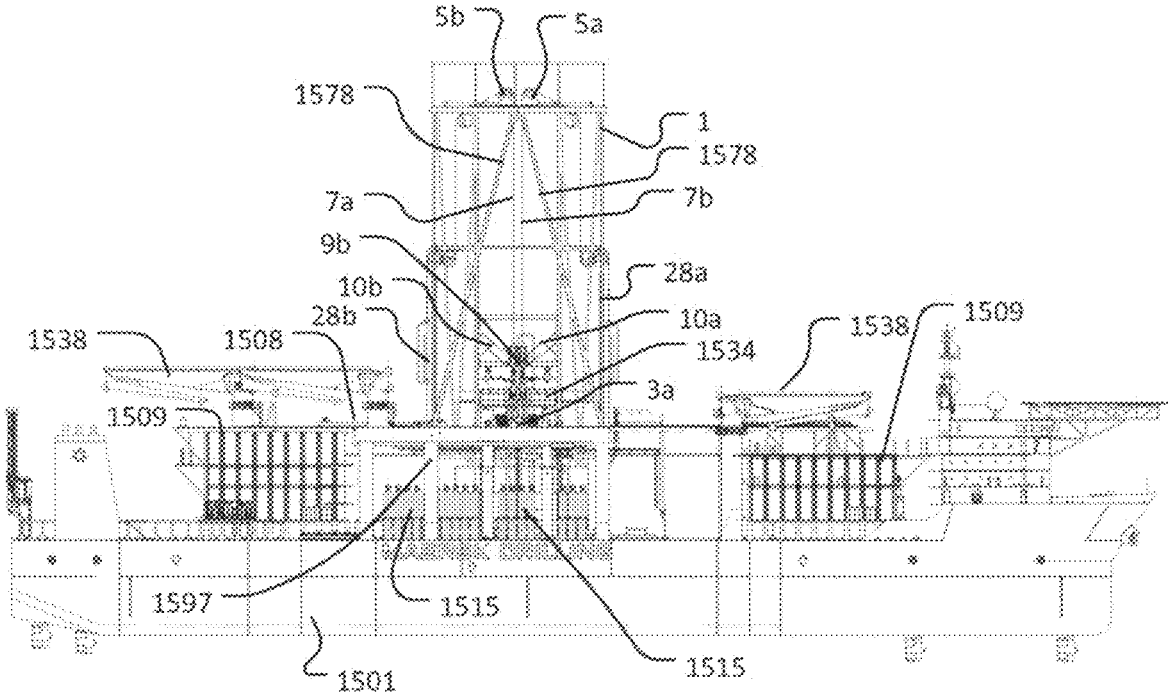
Figure 11:
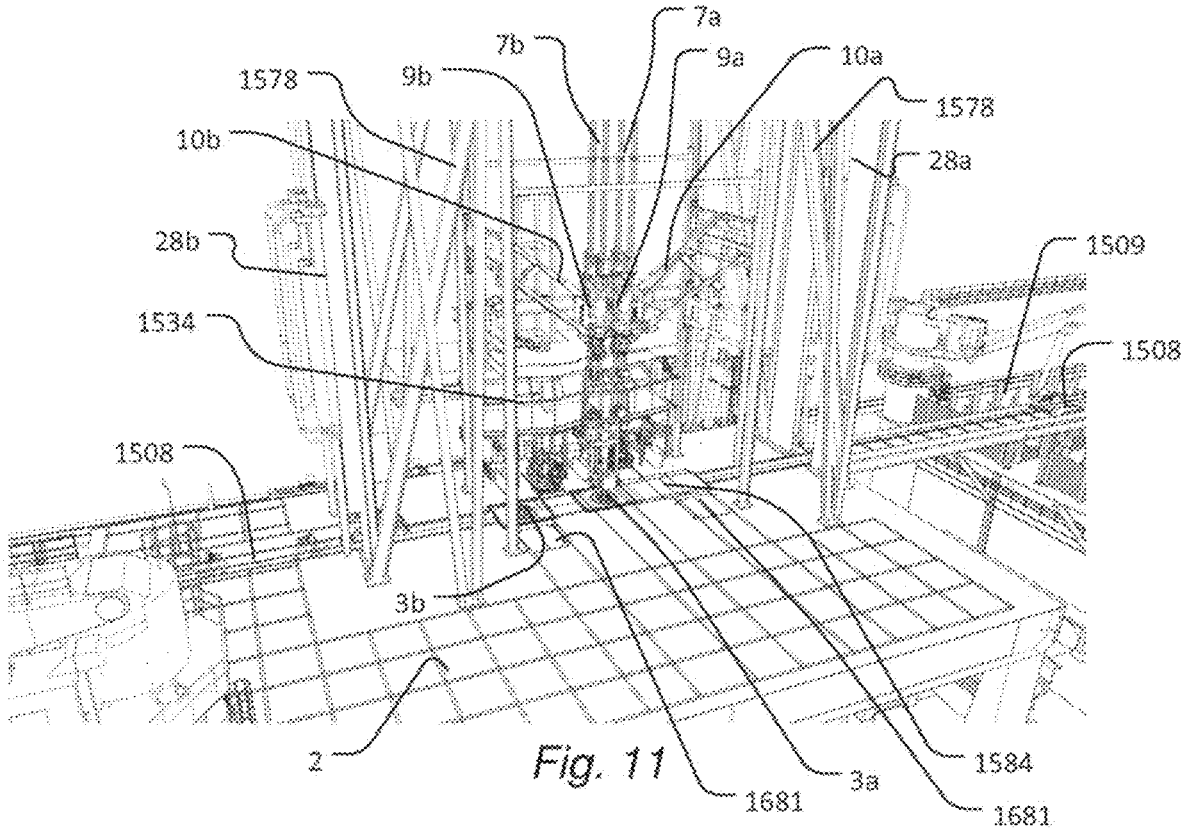
Figure 12:
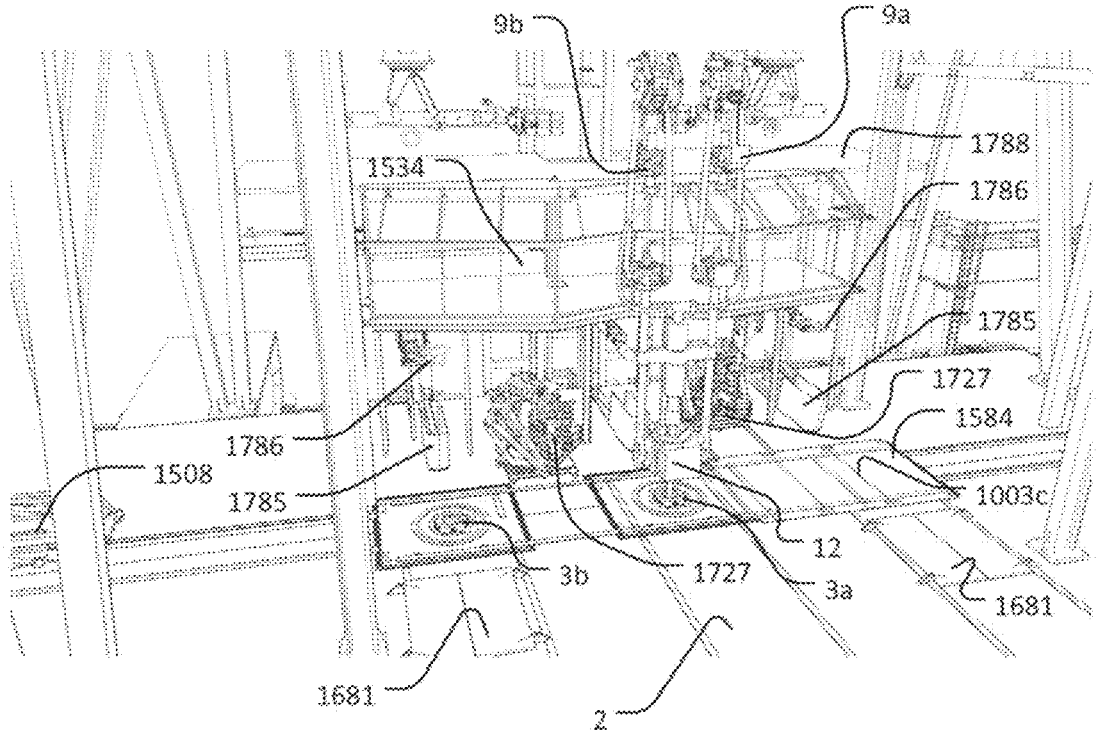
Figure 13:
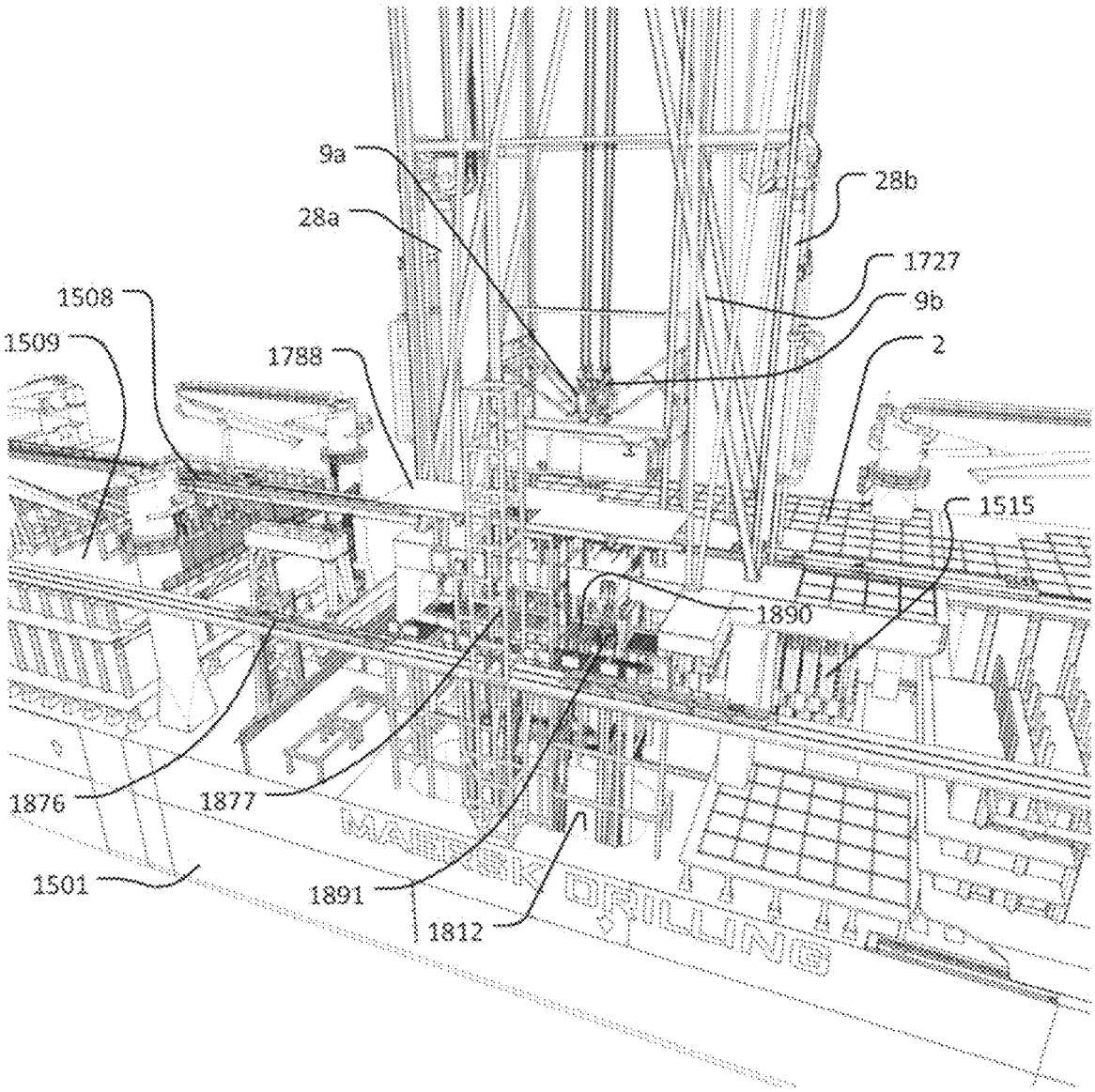
Figure 14:
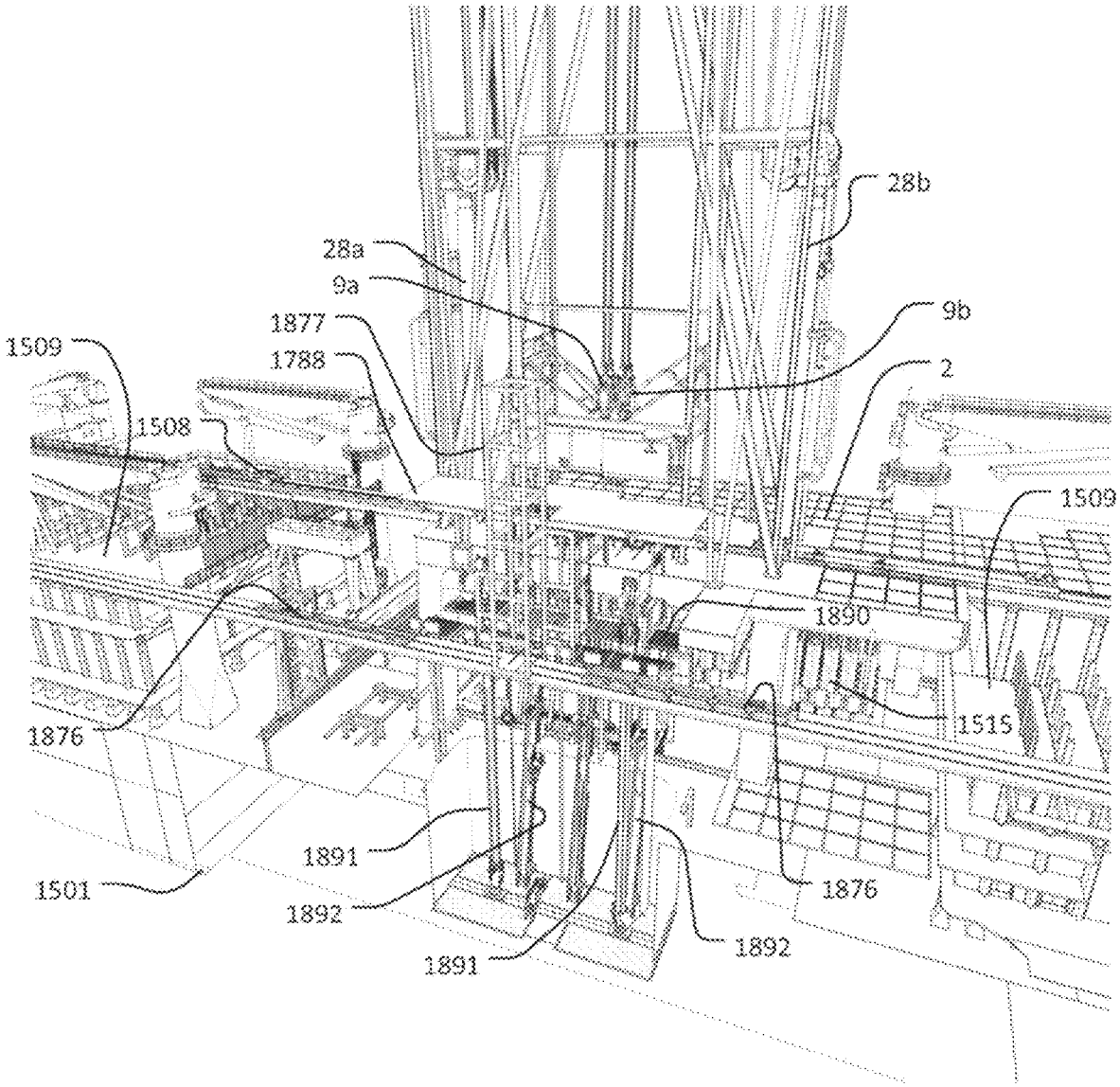
Figure 15:
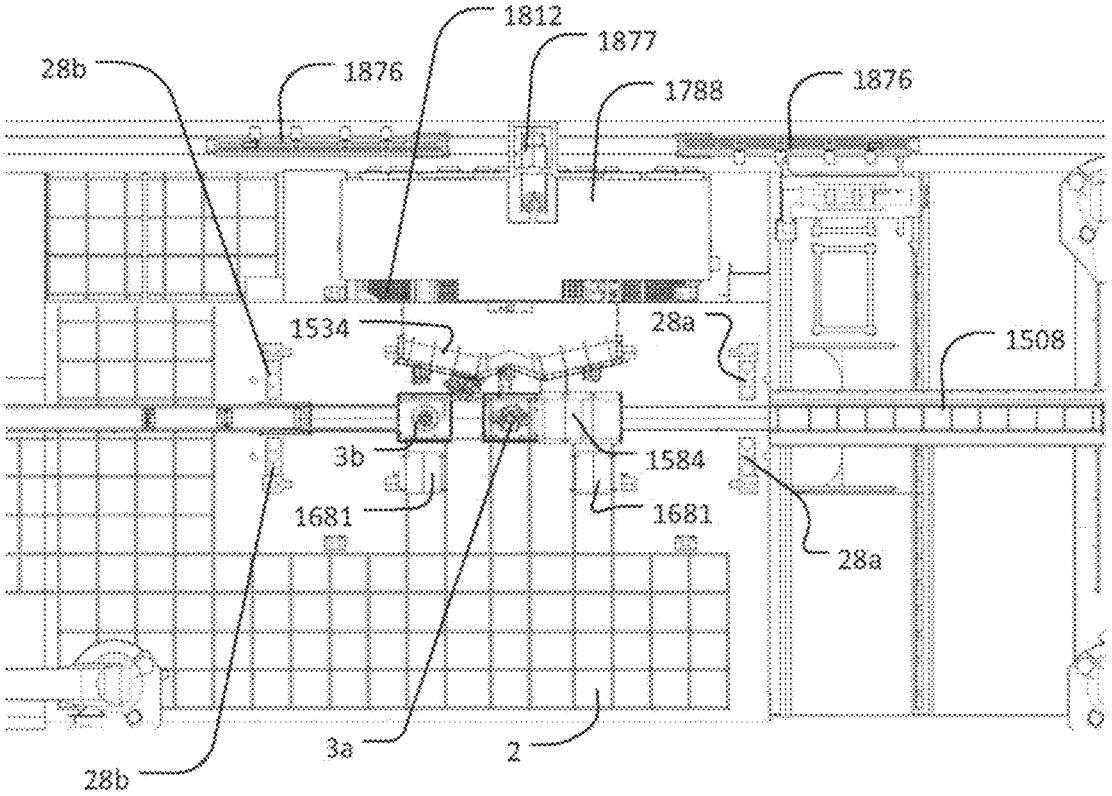
Figure 16:
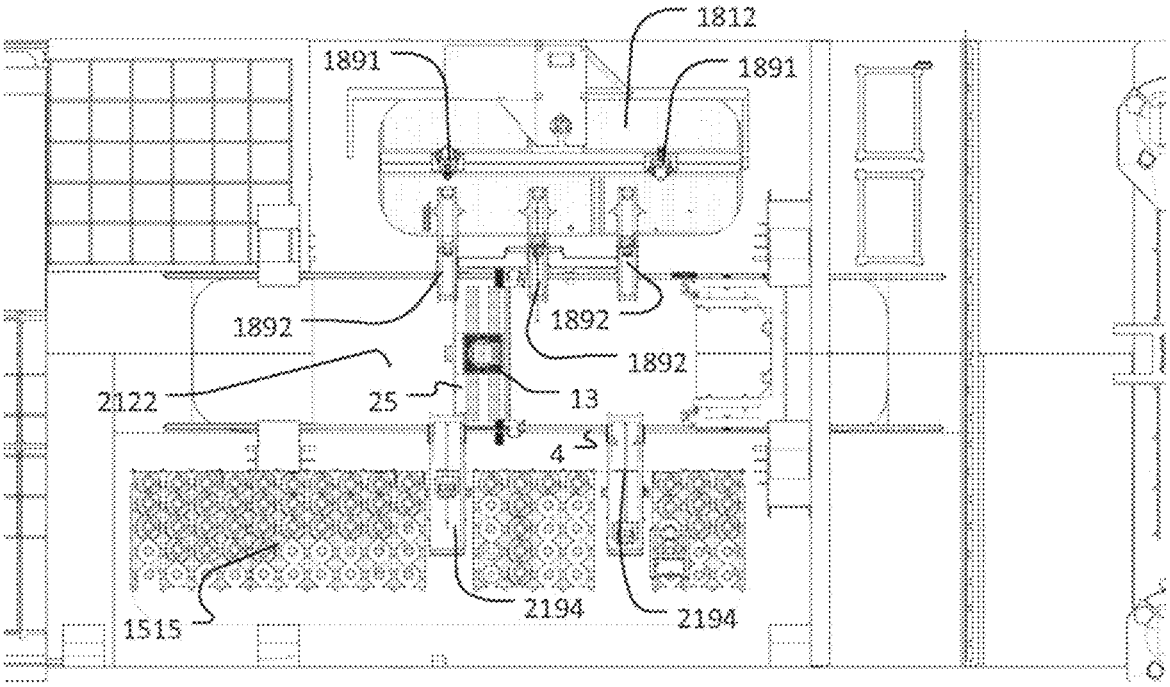
Figure 17:
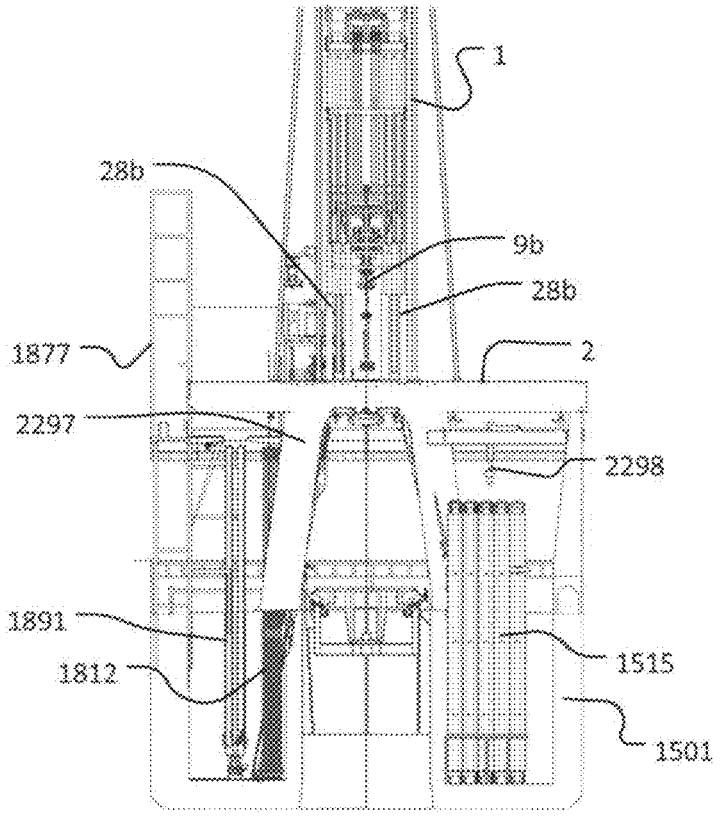
Figure 18:
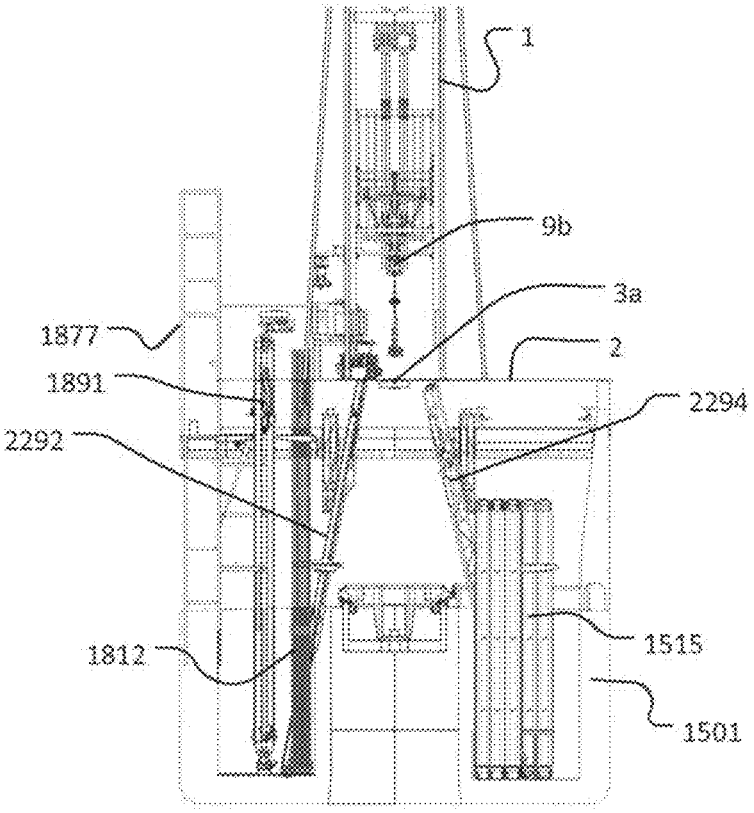

FIGS. 10-18 show another embodiment of a drilling rig, in this example of drillship having a hull 1501. In particular, FIG. 10 shows a side view of the drilling rig, FIGS. 11 and 12 show views of the drill floor seen from the starboard side of the drillship, FIGS. 13 and 14 show views of the drill floor seen from the port side of the drillship (a part of the hull of the ship is cut away in FIG. 14); FIGS. 15 and 16 show horizontal cross sections in a plane above the drill deck and a plane below the drill deck, respectively; finally, FIGS. 17 and 18 show lateral cross sections of the drill ship.

The drilling rig of the present embodiment comprises a drill deck 2 formed on top of a substructure 1597. The substructure comprises a platform supported by legs. The platform defines the drill deck and spans across a moon pool 2122 formed in the hull of the drillship. The drill deck 2 comprises two holes defining well centres 3*a,b*. The drilling rig comprises a drilling support structure in the form of a mast 1. In the present example, the well centres are located within the footprint of the mast 1. The mast includes two mast portions, each associated with, and adjacent to, one of the well centers. The dual activity mast 1 is supported by the substructure 1597 and extends upwardly from the drill deck 2. The mast comprises two mast portions arranged in a face-to-face configuration, i.e. the respective mast portions are located along the axis connecting the well centres such that both well centres are located between the mast portions. Each mast portion supports a hoisting system, each for lowering a drill string through a respective one of the well centres 3*a,b* towards the seabed. In the example of FIGS. 10-18, the drilling rig comprises two well centres, one of which being operable as a primary well centre 3*a* and being equipped with a diverter housing 13. The primary well centre 3*a* is supported on a skidbase 25 on tracks 4 arranged below the drill deck (e.g. as shown in more detail in FIGS. 7 and 8) so as two allow the well centre and the diverter housing 13 to be displaced along the direction connecting the two well centres. Alternatively, both work centres may be provided with a diverter and be operable as primary well centers. The skidbase extends across the moon pool and the tracks are mounted on opposite sides of the moonpool and extends along the direction connecting the well centers. The drilling rig may further comprise a skidable riser tensioning system as described in connection with FIGS. 7 and 8. The primary well center 3*a* may be moved between a first, central horizontal position, as shown in FIGS. 12 and 13, and a second, peripheral position 1003*c*, where the first position is located on the axis connecting the second position 1003*c* and the work centre 3*b*. In the present example, the first position is positioned substantially in the centre between the second position 1003*c* and the work center 3*b*. The position not currently occupied by the displacable well centre (e.g. the second position 1003*c* in FIGS. 12 and 13) may be covered by floor plates or a similar cover 1584. In alternative embodiments, both well centres may be displacable. In yet another embodiment, the drilling rig may comprise three well centres, e.g. aligned along a common axis. Each of the two hoisting systems may be operable to lower tubulars selectively through a work centre at each of at least two horizontal positions, such as the central position (where the primary well center 3*a* is located in the example of FIG. 12) and one of the peripheral positions (the position of the work center 3*b* and the second position 1003*c*). To this end, the mast 1 carries two cable crowns 5*a, b*, e.g. in the form of a crown sheave cluster or in the form of a crown block, being skidably arranged on the top of the mast on separate tracks, so as to enable that each of the cable crowns 5*a*, 5*b* may be shifted horizontally and allowing e.g. that a selected one, or both, of the cable crowns 51, 5*b* is positioned above one specific well center or work center 3*a*, 3*b*.

From each of the cable crowns lifting cables 7*a,b* are running down and connect to a corresponding top drive 9*a,b* which is suspended from a hook or other load carrier connected to the lifting cables. Each of the top drives is connected via a retractable dolly 10*a,b* to a vertical track arranged at the mast 1. The retractable dollies are each adapted so that they can position and keep the top drives in different positions above the well centers, as described herein.

Each hoisting system has one or more linear actuators in the form of a hydraulic cylinder 28*a,b* having its lowermost end fixed with respect to the drill deck and an upper travelling end with a cable sheave. At least one lifting cable has one end extending from another hydraulic cylinder arranged for compensating heave during e.g. drilling operation, and over the travelling cable sheave and further below a second cable sheave being fixed with respect to the mast, and thereafter over the cable crown. The hydraulic cylinders are displaced from the well centres along the direction connecting the well centres and positioned such that both well centres are located between the cylinders of the respective hoisting systems. As can be most easily seen on FIG. 20, the cylinders of each hoisting system are further (optionally) arranged in two groups of cylinders positioned on either side of an axis connecting the well centres so as to form a gap through which a catwalk machine 1508 or other pipe handling equipment can travel and feed tubulars to one or both of the well centres. Each cable crown 5*a,b* defines an axis that is parallel to the direction connecting the two groups of cylinders of one of the hoisting systems.

As is most easily seen in FIG. 12, both hoisting systems may cooperate so as together to lower or raise tubulars through the same well centre, e.g. the primary well center when located at a central position as illustrated in FIG. 12. To this end, a connecting tool 12 may be arranged to connect the top drives 9*a,b*. In this example, the connecting tool is in the form of an elevator and bail sections connected to said elevator in one end and suitable for being lifted by second elevators each connect to a top drives 9*a,b* via bails in the conventional manner. A stabbing and circulation device (e.g. in the form a Casing Fill-Up and Circulating System tools or FLOW BACK & CIRCULATION TOOLS FOR DRILL PIPE (CFT)) is mounted between the bail sections and further connected to a mud connection, preferably of one or both (as illustrated here) of the top drives. Thereby it is possible to connect a load to the connecting tool 12, so that it is possible to provide a lifting force by combining the lifting force of both hoisting systems lifting the connecting tool. To better support increased loads, the mast comprises diagonal beams 1578 forming an inverted V. In alternative modes of operation, the two hoisting systems may be operated above respective well centres or they may be operated in a cyclic dual hoisting mode over a single well centre, e.g. as described herein.

The drilling rig further comprises a pipe storage area 1509 for storing pipes in horizontal orientation and catwalk machines 1508 or other horizontal pipe handling equipment for transporting pipes between the storage area 1509 and the well centers 3*a,b*. To this end, the catwalk machines are aligned with the axis defined by the two well centres.

The drilling rig comprises a setback structure 1812 or similar pipe storage structure for storing stands of tubulars below the substructure 1597 and partly covered by the drill deck 2. The setback structure comprises a support framework 1890 supporting fingerboards having horizontally extending fingers between which tubulars may be stored. The setback structure is arranged so as to allow stands to be moved to/from both well centres from/to the setback. To this end, one or more column rackers 1891 or similar vertical pipe handling equipment may be arranged to move stands into and out of the setback structure 1812. The setback structure 1512 further comprises stand building equipment 1877 configured to build stands from individual pieces of pipe. The setback structure 1812 is located adjacent the moon pool 2122 laterally displaced from the axis defined by the well centers.

Moreover the drilling rig comprises one or more further catwalk machines 1876 configured to feed tubulars from the pipe storage area 1509 or from other storage areas on the opposite side of the mast (towards the aft of the ship) to the stand building equipment 1877. The stand building equipment 1877 may thus receive the pipes from the catwalk machine 1876, bring them in upright orientation, and connect them to other pieces so as to form stands. To this end the stand building equipment may comprise a mousehole through which the stand may be gradually lowered while it is made up until the lowermost end of the stand is at the lowermost level of the setback area 1812, while the uppermost end of the stand is below the drill floor level. The stands may then be received by pipe rackers 1891 and placed in the setback structure 1812 for future use. To this end the pipe rackers are operable to traverse across the setback area, e.g. in the direction parallel to the direction connecting the well centres.

The drilling rig comprises a number of slanted chutes 1892 each for feeding pipes from the setback area 1812 to one of the well centers. To this end the drilling rig may comprise one chute for each well center position, i.e. either the fixed well-center positions or the positions to which a skidable well center can be moved. Alternatively, the chutes may be displacable so as to be selectively aligned with respective well centres. Each chute 1892 receives pipes from one of the pipe rackers 1891 and feed the pipes in a slanted upward direction through a corresponding slit 1785 in the drill floor towards a respective one of the well centres 3*a,b*, where they are picked up at their uppermost end by the corresponding hoisting system and lifted through the slit 1785 until they are vertically suspended above the corresponding well center. To this end, the drilling rig further comprises pipe handling equipment 1786 operable to guide the pipes while they are being lifted through the slit 1785. The slits 1785 are elongated and point away from the axis connecting the well centers and towards the side where the setback area 1812 is positioned. To allow for the pipes to be presented in this fashion, the driller's cabin 1534 is positioned at an elevated level above the slits 1785. One or more further pipe handling devices, such as iron roughnecks 1727, may be located between neighbouring slits and underneath the driller's cabin, e.g. such that each iron roughneck may service two well center positions.

The drilling rig comprises another storage area 1515 below the drill deck 2 and configured for storing risers in a vertical orientation. The riser storage area 1515 is located adjacent the moon pool 2122, e.g. on the side of the moon pool opposite the setback structure 1812. The risers may then be moved, e.g. by means of a gantry crane 2298 and respective chutes 2294 or other suitable pipe feeding equipment through holes 1681 in the drill deck floor. The riser feeding holes 1681 may be covered by removable plates, hatches or similar covers, as illustrated in e.g. FIGS. 13 and 15. The riser feeding holes are displaced from the axis connecting the well centers.

As the stands of tubulars and the risers are stored below the drill deck, and since the cat walk machines 1508 extend towards opposite sides from the well centers, and since the mast structure 1 is located on one side of the well centres, the drill deck provides a large, unobstructed deck area on the side of the well centres opposite the mast. This area provides unobstructed access to both well centres and is free of pipe handling equipment. Consequently, these areas may be used as working area, e.g. for rigging up suspendable auxiliary equipment, and/or for positioning on-deck auxiliary equipment. Moreover, at least parts of the setback structure 1812 may be covered by a platform 1788 so as to provide additional storage or working area.

Although some embodiments have been described and shown in detail, the invention is not restricted to them, but may also be embodied in other ways within the scope of the subject matter defined in the following claims. In particular, it is to be understood that other embodiments may be utilized and structural and functional modifications may be made without departing from the scope of the present invention.

The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. An offshore drilling rig comprising;

a drill deck;

at least two work centers arranged in the drill deck horizontally spaced apart from each other;

a drilling support structure extending upwardly relative to the drill deck;

a first and a second hoisting system supported by the drilling support structure, the first hoisting system being adapted for raising or lowering a first load carrier at a first horizontal position, and the second hoisting system being adapted for raising or lowering a second load carrier at a third horizontal position that is different from the first horizontal position;

the offshore drilling rig comprises a positioning system adapted for:

positioning the first load carrier selectively in at least the first horizontal position and a second horizontal position that is different from the first horizontal position, so that the drilling rig may raise or lower tubular equipment through a work center at the first and second horizontal positions via the first hoisting system, and positioning the second load carrier selectively in at least the first and the third horizontal position, so that the drilling rig may raise or lower tubular equipment through a work center at the first and third positions via the second hoisting system wherein the first horizontal position is placed between the second and third horizontal positions and the drilling rig is further arranged to lift tubular equipment suspended from the first and second load carriers through the work center at the first horizontal position using the first and second hoisting systems in cooperation.

2. The offshore drilling rig according to claim 1, wherein the drilling rig is configurable to raise or lower tubular equipment through the work center at the first horizontal position using the first hoisting system and simultaneously raise or lower tubular equipment through a work center at the third horizontal position via said second hoisting system.

3. The offshore drilling rig according to claim 1, wherein the drilling rig is configurable to raise or lower tubular equipment through the work center at the second horizontal position using the first hoisting system without the second hoisting system.

4. The offshore drilling rig according claim 1, wherein the drilling rig is configurable to raise or lower tubular equipment through the work center at the first horizontal position using the second hoisting system without the first hoisting system.

5. The offshore drilling rig according to claim 1, wherein the work center at the first horizontal position is either displaceable between at least the first and the third horizontal positions or the drilling rig comprises at least three work centers where at least the work center at the first horizontal position is fixed.

6. The offshore drilling rig according to claim 1, wherein the first horizontal position is located between the second and the third horizontal position.

7. The offshore drilling rig according to claim 1, further comprising a connecting tool having two opposite ends each being adapted for directly or indirectly connecting to one of the load carriers, so that the connecting tool can be carried by the first and second load carriers, and where the connecting tool has an intermediate load carrier arranged between said two opposite ends and being adapted for carrying a load.

8. The offshore drilling rig according to claim 1, wherein the positioning system is adapted for shifting both said first and second load carriers, being at said first horizontal position or second horizontal positions, to a position next to the first horizontal position, so that the two load carriers are positioned on opposite sides of the first horizontal position to allow both load carriers to operate simultaneously above the first horizontal position.

9. The offshore drilling rig according to claim 1, wherein the first and the second hoisting system of each of the load carriers lift said load carriers via a lifting cable hanging from a cable crown supported by the drilling support structure, and where the positioning system is adapted for shifting at least one of, or each of the cable crowns to and from the first and the second horizontal position relative to that cable crown where the load carrier is positioned above one of the work centers.

10. The offshore drilling rig according to claim 1, wherein the hoisting systems comprises at least one substantially vertically extending linear actuator having a stationary end being fixed with respect to the drill deck, and a travelling end comprising at least one cable sheave, wherein the linear actuator is a hydraulic cylinder.

11. The offshore drilling rig according to claim 1, wherein the work center at the first horizontal position is displaceable between at least the first and second horizontal positions.

12. The offshore drilling rig according to claim 1, wherein the one or more work centers are mounted in a substantially horizontal track in the drill deck, and where the drill deck comprises a work center positioning system adapted for selectively moving and positioning each of the work centers in the horizontal track to the first or the second or the third horizontal position in the drill deck.

13. The offshore drilling rig according to claim 12, wherein the horizontal track is linear at least along a part of it, and where at least one of the work centers is a primary well center with a diverter system arranged below comprising at least one diverter over board tube having a first end being connected to the primary well center and the other end being supported and fixed with respect to the drill deck and having at least one telescopic section between the first and the second end, the telescopic section extending parallel to a linear part of the horizontal track in the drill deck.

14. The offshore drilling rig according to claim 12, and comprising at least one riser tensioning system arranged below the drill deck, and riser tensioners are mounted on a linear riser tensioner track being arranged below, and in parallel to the horizontal track in the drill deck, so that the riser tensioner selectively can be positioned below a selected work center.

15. The offshore drilling rig according to claim 1, wherein two work centers are both well centers.

16. The offshore drilling rig according to claim 15, wherein the well centers are both primary well centers each comprising a diverter system arranged below the primary well center.

17. The offshore drilling rig according to claim 12, wherein the horizontal track is linear at least along a part of the horizontal track, and the positioning system is adapted for shifting each of the cable crowns along a line being parallel to the linear part of the horizontal track in the drill deck.

18. The offshore drilling rig according to claim 1, wherein one of said work centers is a mousehole, or a standbuilding foxhole.

19. The offshore drilling rig according to claim 1, wherein each of the first and second hoisting systems includes a sheave mounted on the drilling support structure, wherein the sheaves are configured to be movable in a horizontal direction along the support structure.

20. A method of performing drilling operations on a well by using the offshore drilling rig according to claim 1, comprising the steps of:

configuring one or more of the load carriers so that part of the drilling operation is performed using the first load carrier positioned above the work center at the first or second horizontal positions; and configuring one or more of the load carriers so that the first and second load carriers are positioned on opposite sides of the work center at the first horizontal position and lifting or lowering tubular equipment to the seabed through the work center at the first horizontal position using the first and second hoisting systems in collaboration.

21. A method according to claim 20, wherein the two load carriers are connected by a connecting tool, and where the two load carriers are raised or lowered synchronously when carrying a load via the connecting tool.

* * * * *